US007278596B2

(12) United States Patent
Moriya et al.

(10) Patent No.: US 7,278,596 B2
(45) Date of Patent: Oct. 9, 2007

(54) CRUSHER AND MOBILE CRUSHING MACHINE EQUIPPED WITH THE CRUSHER

(75) Inventors: Yukio Moriya, Kanagawa-ken (JP); Hiroshi Yoshida, Kanagawa-ken (JP); Tohru Nakayama, Kanagawa-ken (JP); Yuji Ozawa, Kanagawa-ken (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 11/515,065

(22) Filed: Sep. 1, 2006

(65) Prior Publication Data

US 2007/0001043 A1 Jan. 4, 2007

Related U.S. Application Data

(62) Division of application No. 10/206,614, filed on Jul. 26, 2002.

(30) Foreign Application Priority Data

Jul. 27, 2001 (JP) ..... 2001-228583
Jul. 31, 2001 (JP) ..... 2001-232065

(51) Int. Cl.
*B02C 13/26* (2006.01)

(52) U.S. Cl. ..... 241/189.1; 241/286

(58) Field of Classification Search ..... 241/189.1, 241/286, 37
See application file for complete search history.

(56) References Cited

U.S. PATENT DOCUMENTS 2,858,082 A * 10/1958 Berling ..... 241/56
4,198,005 A 4/1980 Eiff
4,212,432 A 7/1980 Bohne et al.
5,622,322 A 4/1997 Tamura et al.
5,697,562 A 12/1997 Leblond
6,595,444 B2 7/2003 Schwelling
6,745,965 B1 6/2004 Onoda et al.

FOREIGN PATENT DOCUMENTS

| | | |
|---|---|---|
| DE | 976 087 | 2/1963 |
| DE | 1 607 502 | 3/1967 |
| EP | 0 380 811 A2 | 12/1989 |
| EP | 0 391 096 A3 | 3/1990 |
| GB | 1133898 | 2/1967 |
| JP | 3022020 | 12/1995 |
| JP | 09192527 | 7/1997 |
| JP | 5-22042 | 3/1999 |
| JP | 2000015130 | 1/2000 |
| JP | WO 01/02096 A1 | 6/2000 |
| JP | 2003-103186 | 4/2003 |
| JP | 2003103186 | 4/2003 |
| JP | 3460066 | 8/2003 |

* cited by examiner

*Primary Examiner*—Mark Rosenbaum
(74) *Attorney, Agent, or Firm*—Anderson Kill & Olick, PC

(57) ABSTRACT

A mobile crushing machine, equipped with an impact crusher having a separable casing 31 comprising a stationary casing 70 and a movable casing 30, is adopted for casing 31 with the upper end 724 of the stationary casing 70 positioned below the upper end 820 of the movable casing 80 and with the movable casing 80 arranged to permit an operator to collapse the feeding port 31A side of movable casing 80 into the rotation mechanism 39 for transporting the mobile crushing machine The impact crusher is equipped with a gap adjustment device (60).

8 Claims, 20 Drawing Sheets

CRUSHER AND MOBILE CRUSHING MACHINE EQUIPPED WITH THE CRUSHER

The present invention is a divisional application of U.S. Ser. No. 10/206,614 which was filed on Jul. 26, 2002 and which was allowed on May 9, 2006, and relates to a crusher and mobile crushing machine equipped with a crusher, preferably an impact crusher.

FIELD OF THE INVENTION

Background of the Invention

A mobile crushing machine transported to crushing sites or building demolition sites can self-propel within a site if it is equipped with Crawler type traveling components. Nonetheless, this crushing machine cannot self-propel to the construction site on a public highway and therefore, must be towed by a trailer to the site.

Usually, a crusher installed on such a mobile crushing machine has a casing having a feeding port for feeding materials to be crushed.

Sometimes, a larger crusher, that can easily crush large rocks, concrete or asphalt blocks, is required for improved crushing efficiency. However, an increase in capacity of a crusher requires an increase in capacity of its casing. This requires one casing to have a large height, which may exceed the height limit imposed for its transportation by a trailer. To meet the height requirement, the crusher must be adapted to separate into components. These components must be reassembled when they arrive at the site which is elaborate work, time consuming and undesirable.

In an impact crusher, materials to be crushed are struck by stroke plates of a stroke component driven by a revolving rotor followed by collision onto impact plates to which the materials fly due to the striking action of the stroke plates. The size of the crushed pieces are determined by the gaps between the stroke plates and the impact plates. Therefore, to obtain crushed pieces of a given size, it is necessary to precisely adjust and maintain a desirable gap between the stroke plates and impact plates by moving the impact plates. Accordingly, the crusher of the present invention preferably includes a gap adjustment device for adjusting the gap between a stroke component (stroke plates) and the impact plates.

SUMMARY OF THE INVENTION

In one embodiment of the present invention, the crusher is characterized by having a casing separable into a stationary casing and a movable casing with the movable casing fitted above the stationary casing so that the upper end of the stationary casing is positioned below the upper end of the movable casing. As such, even though the capacity of the casing is increased, the overall height of the casing is reduced for purposes of transportation. If the movable casing is moved downwardly to lower its position relative to the stationary casing or the movable casing is removed from the top of the stationary casing, the height regulation for the crusher can be met. Moreover, either the stationary casing or movable casing can collapse into one another. As a result, the height of the casing can be reduced easily without completely removing the movable casing from the stationary casing.

Furthermore, the casing is capable of maintaining multiple positions including at least an operating position in which the movable casing can perform the crushing operation and a transporting position in which the movable casing is inverted downward. When the crusher crushes materials, the movable casing is maintained in a position defining closed operating position; and when the crusher is being transported, the movable casing is maintained in an inverted downward position. By maintaining the movable casing in different positions for the different functions, an inadvertent change in position during crushing or transporting will not cause a problem, thereby ensuring efficient crushing and transporting without interruption.

In the crusher of the present invention, the height of the overall casing is reduced during transportation by moving the movable casing from the operating position to an inverted downward position so that the movable casing can have the full height required during crushing without the need for a larger feeding port. A larger feeding port has the drawback in that even though it is easy to feed larger materials for crushing through a larger opening, it is also easy for materials to fly out of the casing. To overcome this drawback, an eave is provided at the position where a feeding port is formed in the movable casing such that materials to be crushed will bounce off the eave during crushing. This can effectively prevent materials being crushed from flying to the outside. A suspension member such as a chain or curtain may be suspended from the eave to prevent materials being crushed from flying outside.

In addition, a rotation mechanism may be included to join the stationary casing to the movable casing. The rotation mechanism is provided on the upper side of the entire casing, and the movable casing turns around at a higher position. As a result, little space is required for opening the casing below the rotation mechanism. The dead space of conventional technology crushers is thus effectively utilized.

The rotation mechanism is provided on the side opposite to the feeding port for feeding materials to be crushed in the casing and is preferably at the upper level of the casing.

In a second embodiment of the present invention in which the crusher includes a gap adjustment device, the gap adjustment device comprises a rotor having a stroke component with stroke plates and impact plates separated from the stroke plates by gaps; a casing wherein the rotor and the impact plates are fitted; an impact plate side member fitted to a side of the impact plate; a casing side member screwed or meshed with the impact plate side member; and a drive component for rotating the casing side member; wherein the gaps between the stroke plates and the impact plates can be adjusted in accordance with the number of revolutions made by the casing side member.

The impact plate side member and the casing side member are linked together in a preferred manner in which one member has a nut-like shape and the other member has a bolt-like shape which mesh together. Alternatively, the impact plate side member and the casing side member may be linked together wherein one member has a rack-like shape and the other member has a pinion-like shape which mesh together. Usually, in this casing, the pinion shaped element is driven to rotate.

When the impact plate side member and the casing side member are meshed together, they support the impact plates. In addition, clockwise or counterclockwise revolutions of the casing side member driven by the driving component, moves the impact plate side members to and from the casing side member without undulations. The gaps between the stroke component and the impact plates are thus adjusted easily and arbitrarily.

Moreover, since the impact side member and the casing side member are meshed together, they do not move or shift as long as the impact plates are stationary, holding the impact plates thereon without failing and without requiring a complex holding mechanism. In this way, the gap size is thus maintained accurately.

Another embodiment of the present invention relates to a mobile crushing machine equipped with an impact crusher with the crushing machine comprising a base component having traveling components, a power component and with the crusher having a separable casing comprising a stationary casing and a movable casing fitted to the stationary casing; wherein the movable casing is fitted above the stationary casing so that the upper end of the stationary casing is positioned below the upper end of the movable casing.

A mobile crushing machine equipped with an impact crusher of this type has little dead space around it, and the mobile crushing machine can be made smaller by eliminating dead space, thereby increasing the mobility of the crushing machine. This particularly improves maneuverability, thereby qualifying the machine for crushing in a narrow working area.

BRIEF DESCRIPTION OF THE DRAWINGS

FIG. 21(*a*) is a cross section taken along the lines 21-21 of FIG. 21.

DESCRIPTION OF THE PREFERRED EMBODIMENTS

Figure 20:
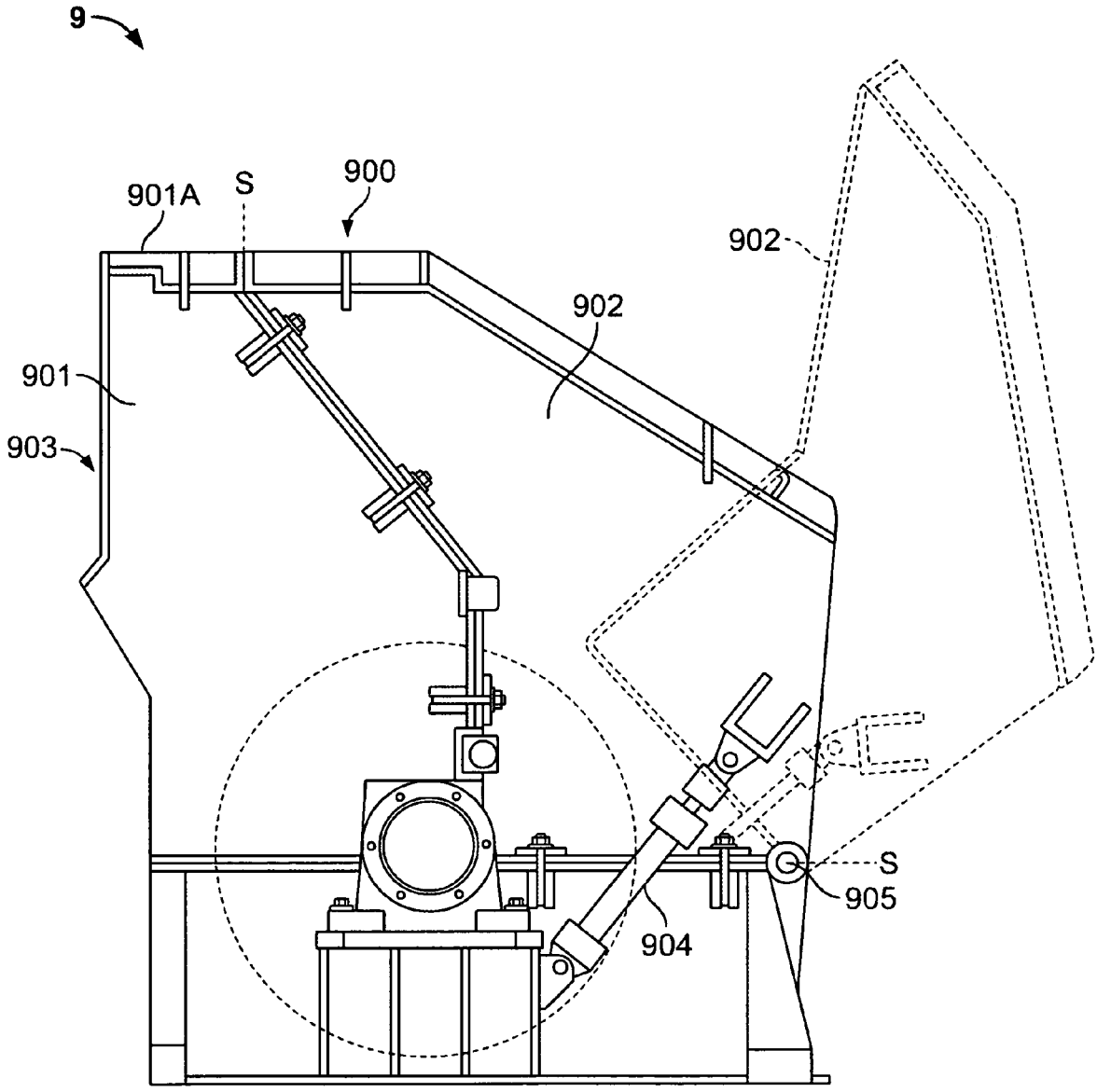
FIG. 20 (Prior Art)
FIG. 20 is a side view showing a crusher casing of conventional technology.

A conventional impact crusher 9 is illustrated in FIG. 20, formed of a casing 900 having a stationary casing component 901, which is fixed onto a base component of a mobile crushing machine (not illustrated), and a movable casing component 902 which is joined to the stationary casing 901 by a pin. A feeding port 903 is provided on the stationary casing 901 side of the impact crusher 9.

In the conventional crusher 9, the stationary casing component 901, on the left side of the casing 900, is separated from the movable casing component 902 on the right along the separation line S-S. Hydraulic cylinder 904 turns movable casing 902 around pin 905 connecting the stationary casing 901 and movable casing 902. By opening movable casing 902 separated along the separation line S-S, an operator can perform a repair, inspection, or the like for the impact crusher. In addition, by opening movable casing 902, top component 901 A stays on the side of stationary casing 901, thereby maintaining the height for casing 900 whether movable casing 902 is open or closed.

When the movable casing 902 is open, the movable casing 902 rotates around pin 905 below such that it extends toward its front (right in the figure, side opposite to feeding port 903). Therefore, there must be a wide-open space in front of casing 900, requiring a dead space in the movable casing 902, even when it is not in use. Hence, depending on the capacity of the dead space, there may be a concern that an increase in the overall length of a mobile crushing machine increases the volume of dead space, providing adverse effects on the mobility of the mobile crushing machine.

Figure 1:
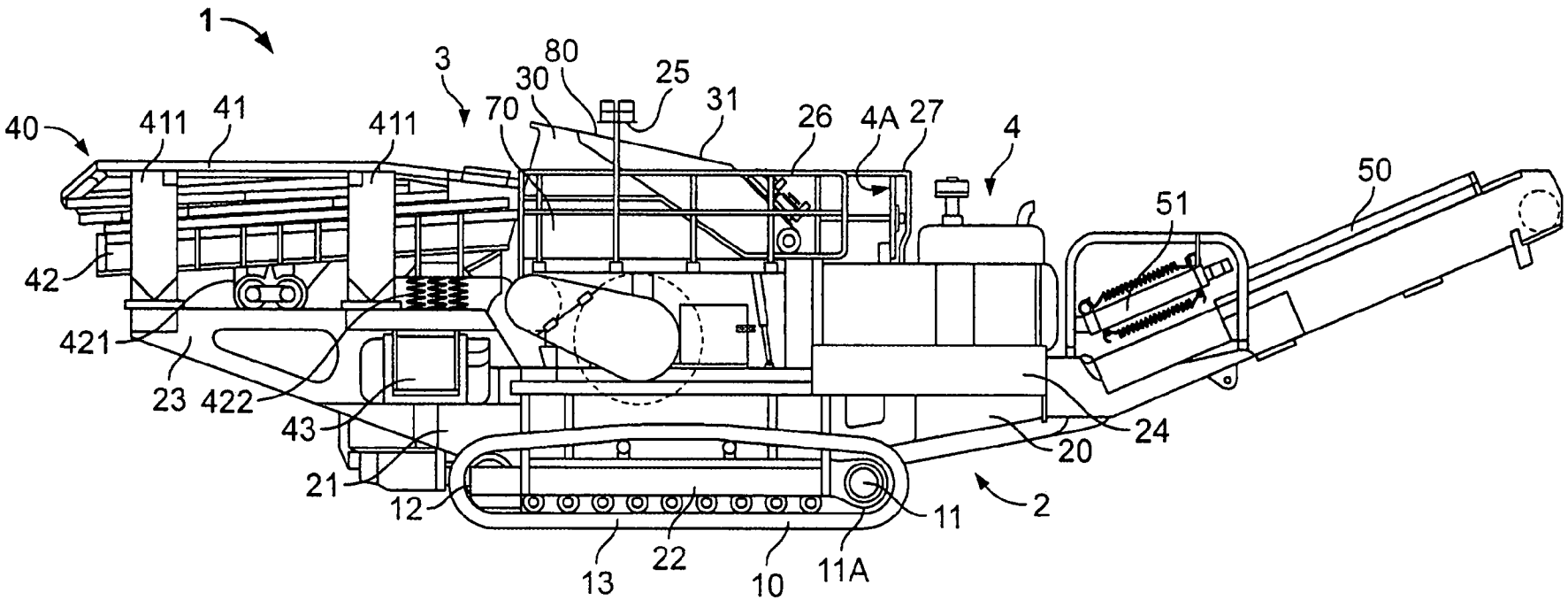
FIG. 1 is a side view illustrating the mobile crushing machine equipped with an impact crusher in accordance with the present invention.
Figure 3:
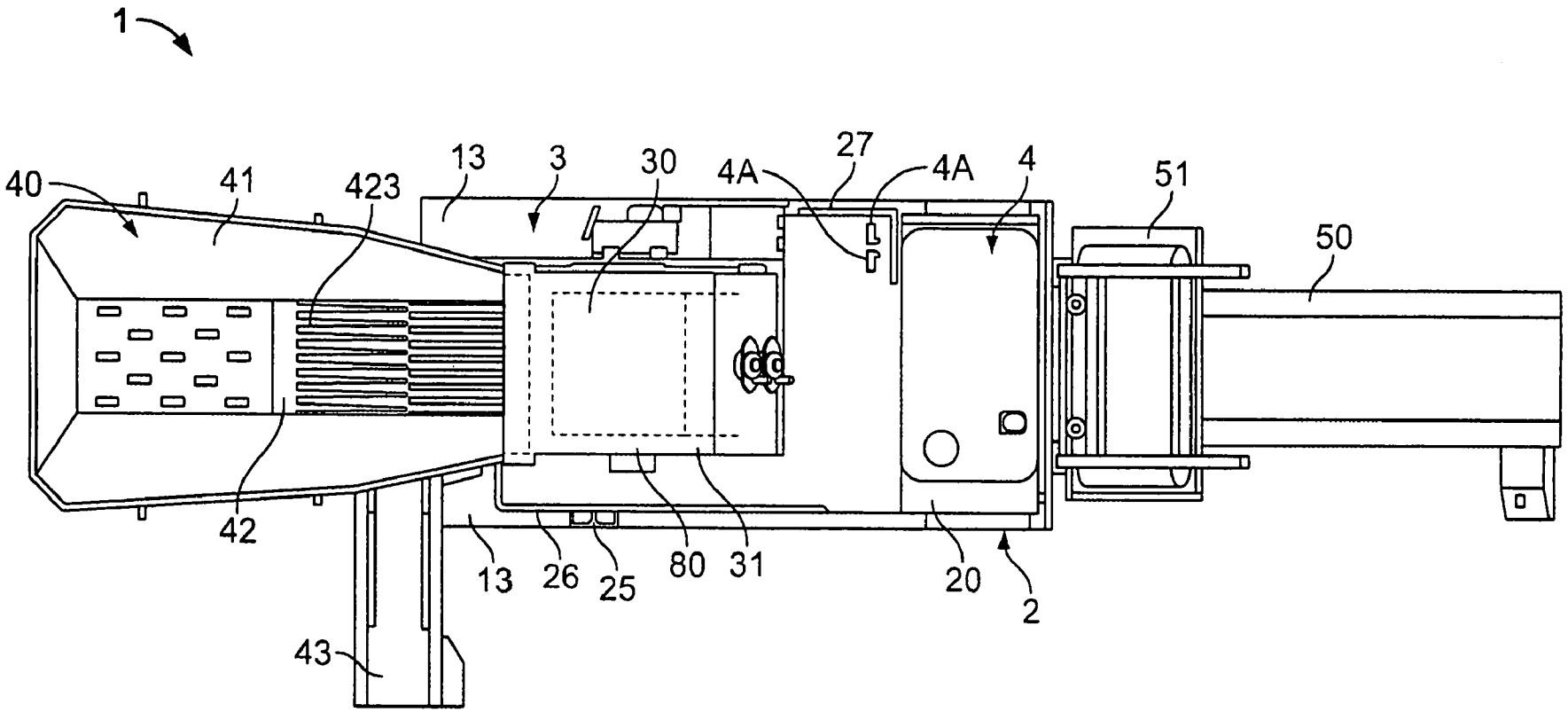
FIG. 3 is a plan view showing the mobile crushing machine of FIG. 1.

The mobile crusher 1 of the present invention is shown in FIGS. 1 and 3 and is constructed with a base component 2 on which handling machine 3 and power component 4 are installed.

The base component 2 comprises: a pair of traveling components 10 of the crawler type for traveling at the construction site; and frame 20 on which traveling component 10 is fitted and handling machine 3 and power component 4 are received thereby.

Handling machine 3 comprises: an impact crusher 30 (hereinafter referred to as a "crusher") mounted on an approximate center of base component 2 representing a crusher; feeder component 40 for feeding materials to be crushed; and discharge belt conveyer 50 for discharging crushed pieces.

Power component 4 is the power source for traveling components 10, crusher 30, and discharge belt conveyer 50 and the like, and comprises: an engine (not illustrated), hydraulic pump driven by the engine; and a control valve for controlling hydraulic fluid from the hydraulic pump, and the like. Traveling lever 4A, by which the machine propels and circles, and an upper control box (not illustrated) where indicators for traveling are arranged therein are provided on the upper side of power component 4 in mobile crushing machine 1. In the vicinity of power component 4 is provided a side component control box (not illustrated) required for operating handling machine 3.

Each component is described by assuming the discharge conveyer 50 side of mobile crushing machine 1 as the front (right side in FIG. 1) and the side where feeding components 40 for materials to be crushed is located as the back (left side in FIG. 1), and the direction which is perpendicular to the front-back (right-left in FIG. 2) direction as the horizontal direction.

Traveling components 10 are provided on crawler frames 22 constituting a part of frame 22 and hydraulic motor 11 are provided at the front end of crawler frame 22. Crawler belt 13 driven by hydraulic motor 11 is wrapped around sprocket 11A of hydraulic motor 11 and idler 12 arranged at another end. Hydraulic motor 11 is driven by hydraulic pressure from hydraulic pump in power component 4 via control valve.

Frame 20 comprises a pair of crawler frames 22 and mainframe 21 wherein a pair of crawler frames 22 is attached onto mainframe 21. On mainframe 21 are fixed hopper frame 23 for mounting feeding components 40 for feeding materials to be crushed and engine frame 24 for mounting power component 4.

Figure 4:
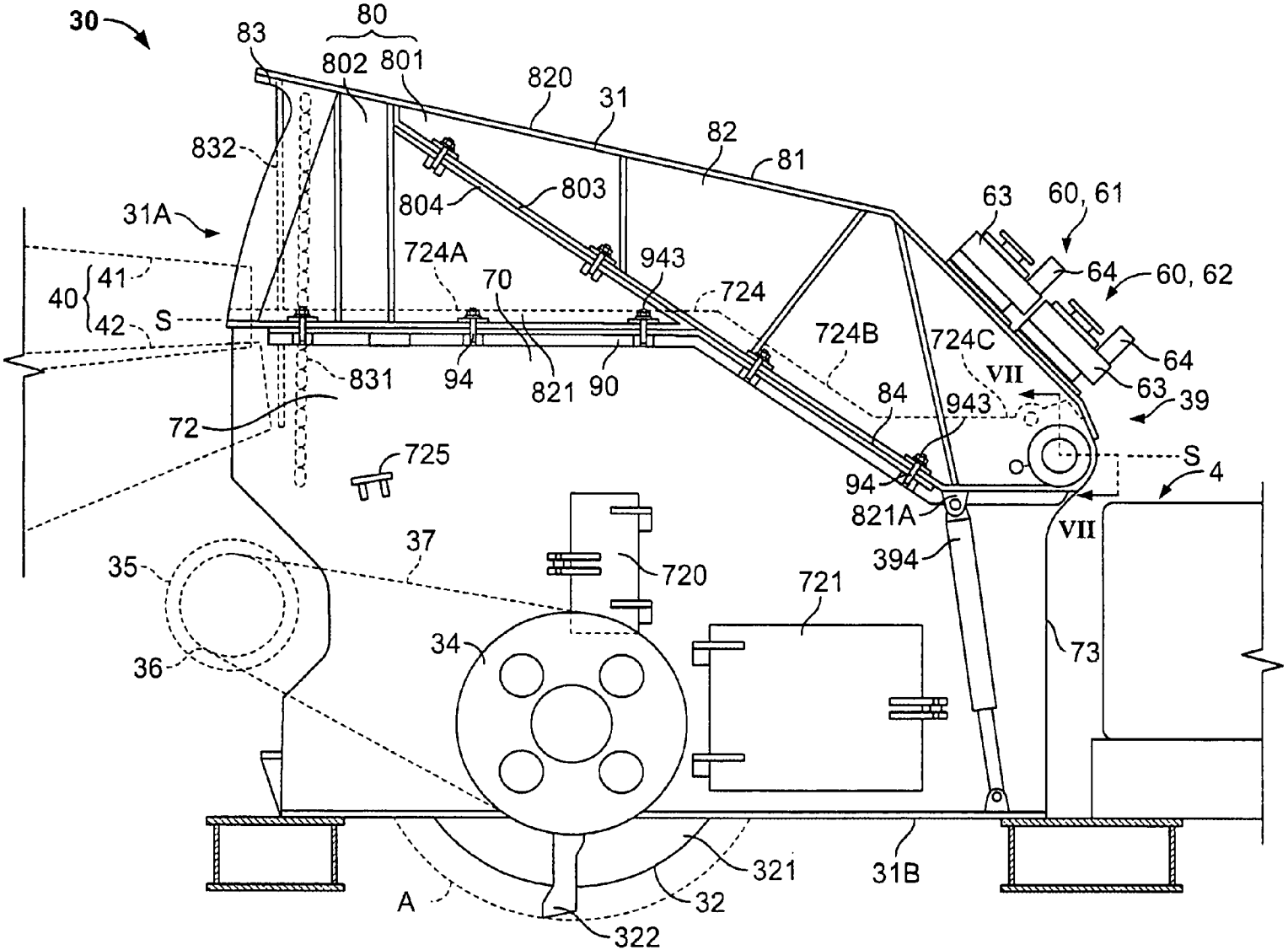
FIG. 4 is a side view illustrating the movable casing constituting the casing in the crusher of FIG. 1 shown in the operating position.
Figure 5:
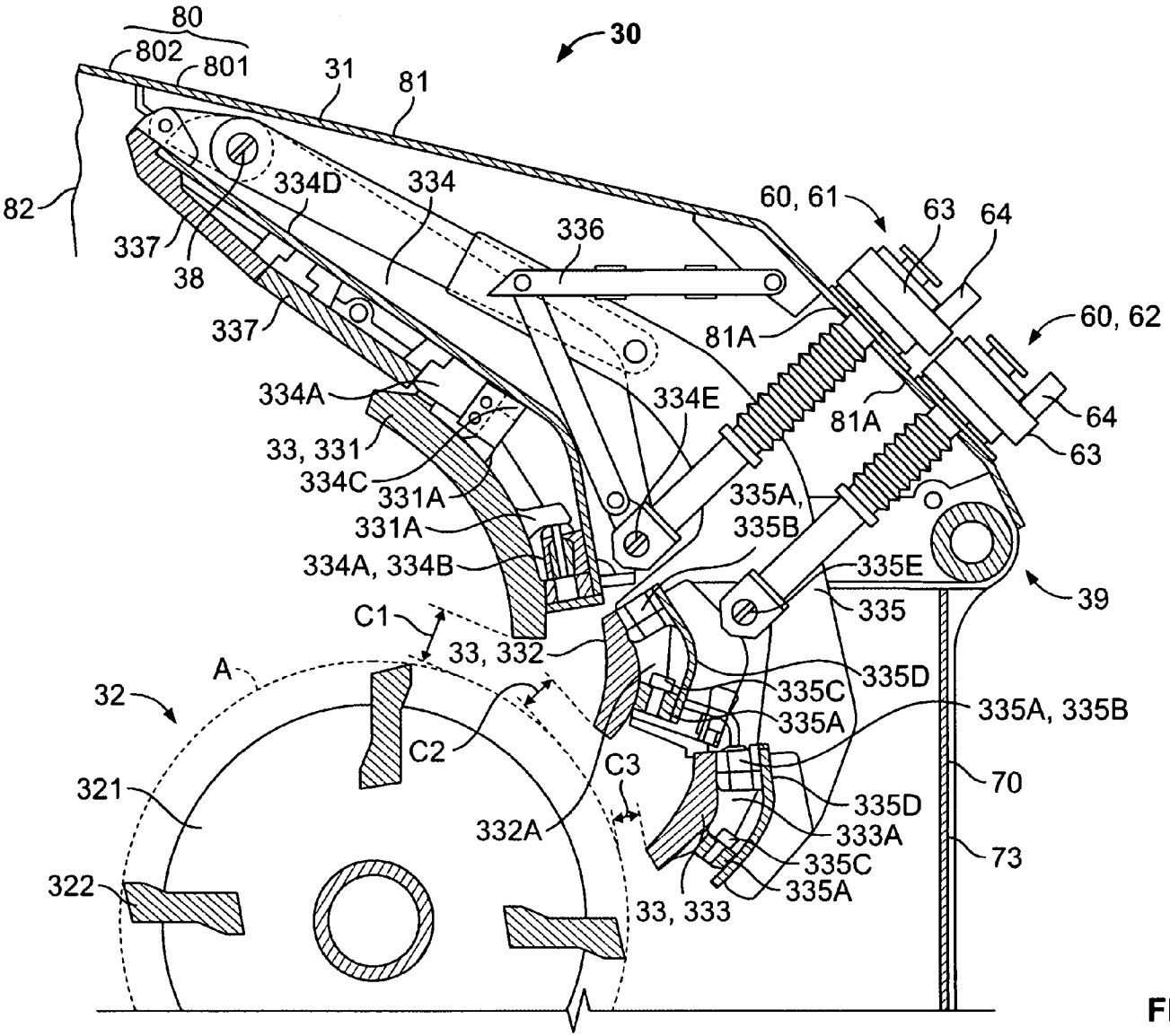
FIG. 5 is a cross section showing a part of the internal structure of the crusher of FIG. 1.

Crusher 30 has, as illustrated in FIGS. 4 and 5, casing 31 having feeding port 31A for feeding materials to be crushed and rotor body 321 and rotor 32 arranged therein, having stroke plate 322 and impact plates 33 distanced from the rotation orbit A for the tip of stroke plate 322.

In crusher 30, materials to be crushed are fed into feeding port 31A to be crushed in such a way that they impact rotating stroke plate 322 or are bounced against impact place at the time of striking. The crushed materials fall down onto discharge belt conveyer 50 from discharge port 31B at the bottom side of casing 31.

Feeding components 40 for materials to be crushed comprises hopper 41, to which material to be crushed are charged, and grizzly feeder 42 arranged below hopper 41 putting some gap there between.

Figure 2:
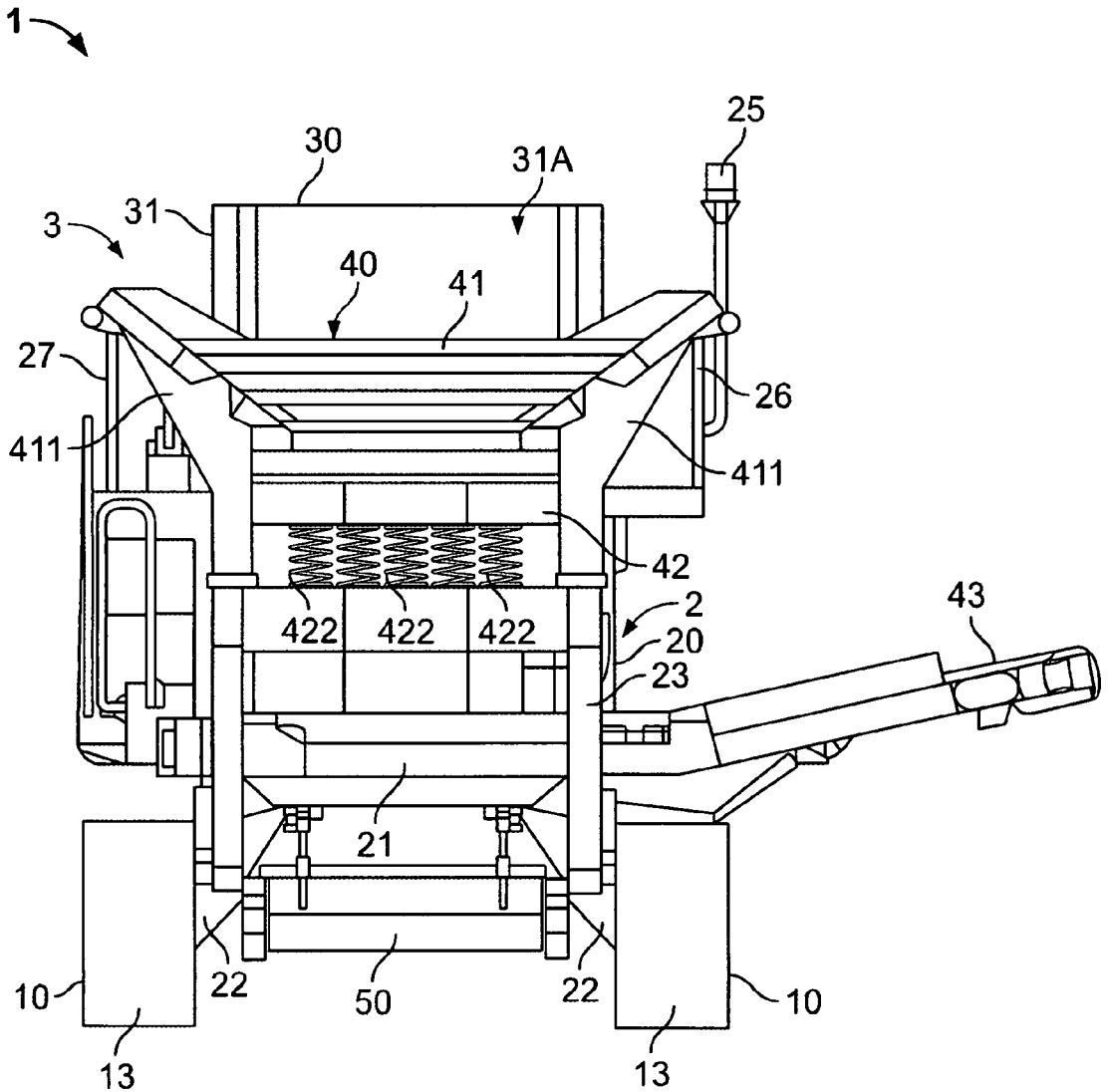
FIG. 2 shows the mobile crushing machine of FIG. 1 viewed from the side where materials to be crushed are charged.

As shown in FIG. 2, hopper 41 is held above hopper frame 23 via supporting components at four sides, opening wide upward.

Feeder 42 is of a vibration type having vibration exciter 421 (FIG. 1) driven by hydraulic pressure from power component 4 and supported above hopper frame 23 via multiple coil springs 422 such that feeder 42 vibrates within the abovementioned gap without contacting hopper 41 to feed materials to be crushed into crusher 30. At this time, edges of hopper 41 and feeder 42, as marked with two dotted lines, rises into feeding port 31A for crusher 30 to ensure feeding of materials to be crushed into crusher 30.

In addition, feeder 42 selects small materials that do not require crushing by grizzly 423 (FIG. 3) to discard them. Materials that are discarded may fall on another belt conveyer 43, shown in FIG. 1 or FIG. 3, to be charged, or a damper may be turned on to discard small materials on discharge belt conveyor 50 to discharge small materials with crushed pieces.

The base end (left side in FIG. 1) of discharge belt conveyer 50, viewed in the transfer direction, is positioned below frame 20 to convey crushed pieces discharged from discharge port 31B for crusher 30 or waste (same as the abovementioned materials that are fed) from grizzly component 423 toward the tip (right side in FIG. 1) as required. In addition, discharge belt conveyer 50 has a three-fold structure to provide the height required for the tip to discharge [crushed pieces and wastes] without requiring a secondary belt conveyer. Discharge belt 50 is also driven by hydraulic pressure from power component 4.

In the middle of discharge belt conveyer 50 is arranged magnetic selection machine 51 in a manner that it is supported by frame 20 to attract metallic materials (e.g. reinforcing bars) that come from crushed concrete blocks, which are discharged by a belt conveyer attached thereto.

Description of Crusher

Crusher 30 is described in detail herein with reference to FIGS. 4 and 5.

First, both ends in horizontal direction of rotor 32 for crusher 30 are supported by external bearings (not illustrated) and a pulley 34 is provided at one end. Also, hydraulic motor 35, marked with two-dotted lines, is arranged outside casing 31. V-belt 37 is wound around pulley 36 for hydraulic motor 35 and pulley 34. In other words, rotor 32 is driven and rotated by hydraulic motor 35 via V-belt 37. Hydraulic motor 35 is also driven by hydraulic pressure from hydraulic pump in motor component 4 via a control valve.

Stroke plates 322 for rotor 32 are continuously provided along the horizontal direction (in the axial direction of rotor body 321) within a range somewhat narrower than the horizontal width, wherein multiple (four pieces in this embodiment) stroke plates 322 are provided at an even distance in the circular direction of rotor body 321 and in a protruding manner. Stroke plates 322 are also detachable; therefore, they can be rotated inversely or replaced with new stroke plates 322 in accordance with their state of wear.

Next, in FIG. 5, stroke plates 33 for crusher 30 are referred to as, in order from the feeding port 31A side (FIG. 4) along rotational direction of rotor 32, first impact plate 331, second impact plate 332, and third impact plate 333.

The first impact plates 331 are larger than other impact plates and can receive large materials to be crushed soon after charging. On the back of first impact plates 331, a pair of projection components 331A is provided for latching. The pair of projection components 331A for latching is caught between latch components 334A under first arm 334 and held between fixture 334B of a screw type attached to one of the latch components 334A and by clamp 334C attached at the horizontal end. Multiple first impact plates 331 are arranged closely in a row in the horizontal direction. By releasing fixture 334B and clamp 334C, each first impact plate 331 can be inserted or removed in a horizontal direction so as to be rotated inversely or to be replaced with new stroke plates in accordance with their state of wear.

These second impact plate 332 and third impact plate 333 are of the same shape. They are held between latch components 335A under second arm by fixture 335B and by clamp 335C via projection components 332A and 333A for latching, which are provided on the back [of second and third impact plates 332 and 333]. These second and third impact plates also can be inserted or removed to/from second arm 335 to be replaced with new plates in accordance with their wearing state. Note that second and third impact plates are not so large and are uniformly worn out throughout the plate during crushing. It is unlikely that these plates are rotated in reverse; however, they can be configured in the same manner as first impact plate 331, which can be rotated in reverse.

A pair of first arms 334 and a pair of second arms 335 is arranged in a row at a distance in the horizontal direction, and each is integrally each joined with joint plates 334D and 335D and each joint bars 334E and 335E respectively. Each second arm 335 is arranged between a pair of first arms 334.

The upper side of first and second arms 334 and 335 is supported by rotation shaft 38 at an upper level in casing 31. In contrast, the lower side of first and second arms is suspended from flexible first and second gap adjustment devices 60 (61, 62) that are fitted to joint bars 334E and 335E.

These first and second gap adjustment devices 61 and 62 have a structure that expand or contract by driving hydraulic motor 64 toward the upper end of power component 63. The structure may be, for example, a screw type or the like including a nut member and a bolt member. Expansion or contraction of first and second gap adjustment devices 61 and 62 turns first and second arms 334 and 335 around rotation shaft 38 so as to adjust rotary locus A for the tip of stroke plate 322 and the size for gaps C1, C2, and C3 between each of the first, second, and third impact plates 331, 332, and 333.

Although there are second and third impact plates 332 and 333, second gap adjustment device 62 adjusts gap C3 for third stroke plate only. This is because adjustment of gap C3 is important for determining the final particle size of crushed pieces. Hence, adjustment of gap C2 for second impact plate 332 on the same second arm is automatically done by adjusting gap C3 taking advantage of the positional relationship between the second and the third stroke plates.

On first arm 334, regulation link 336 of a crouching type is provided for regulating the amount of circular motion in the expansion direction of first gap adjustment device 61. This regulation link 336 prevents first gap adjustment device 61 from excessive expansion thus regulating the amount of circular motion of first arm 334. In contrast, it is the contact of second arm 335 against first arm 334 that regulates the amount of circular motion for second arm 335.

Moreover, liners 337 are fitted to first arm 334 above first impact plates to protect first arm 334 from materials to be crushed and the like wherein liner 337 can also be inserted or removed from first arm 334.

Detailed Description of Crusher Casing

Figure 6:
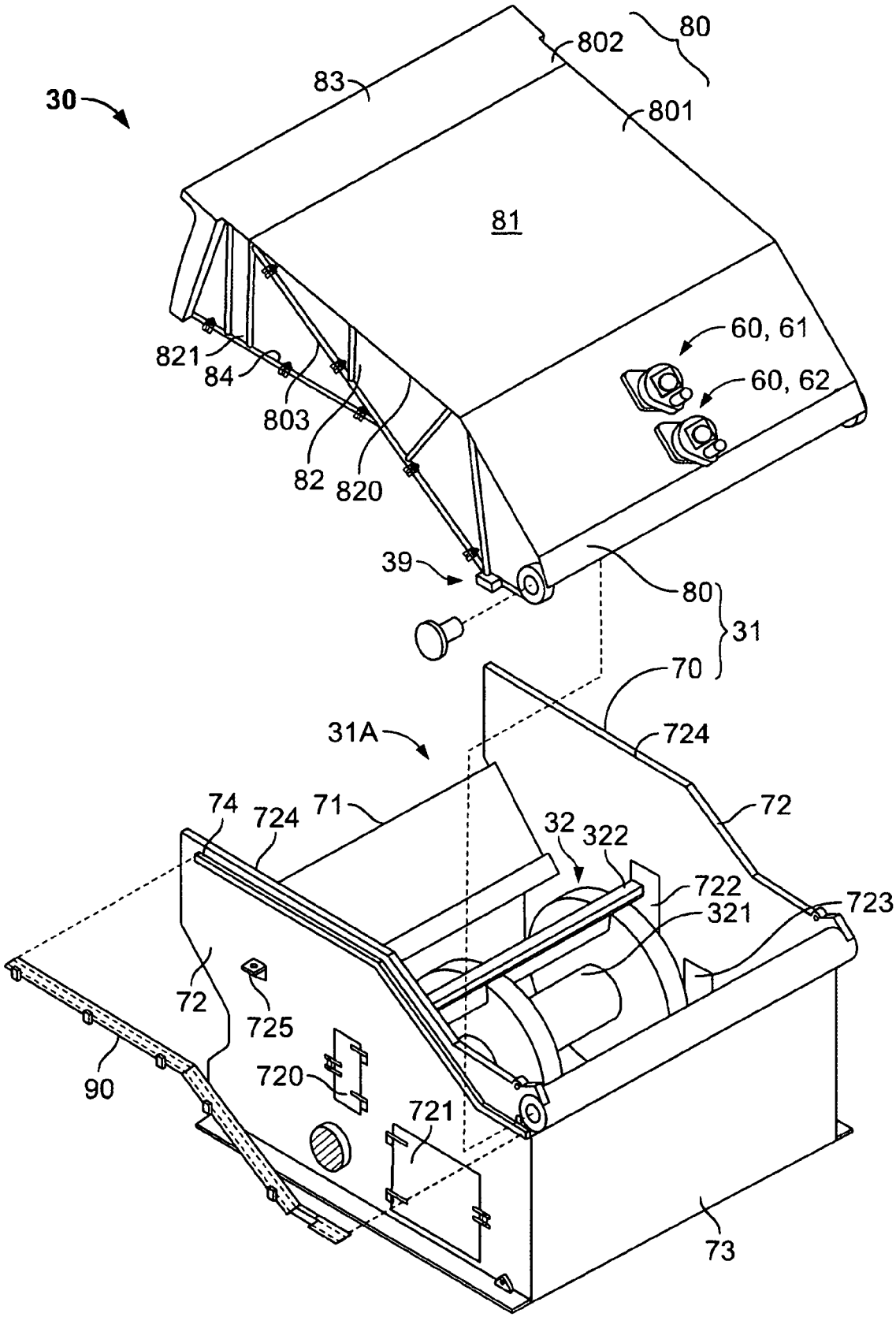
FIG. 6 is an exploded perspective view of the crusher of FIG. 1.

Next, the separable casing 31 of crusher 30 is described herein with reference to FIGS. 5 and 6. The separable casing 31 is separable into a stationary casing component fixed onto frame 20 (FIG. 1) and a movable casing component 80 fitted to the upper side of stationary casing 70. Rotor 32 is arranged in stationary casing 70 while first-third impact plates 331 to 333, first and second arms 334 and 335, and first and second gap adjustment devices 61 and 62 are fitted to movable casing 80 as illustrated in FIG. 5.

Stationary casing 70, shaped like a box, comprises: front component 71; side component 72 on the stationary casing side provided on both ends in a horizontal direction; and rear component 73 provided on the opposite of frontal component 71 [(FIG. 6)]. Stationary casing 70 is entirely topless and does not have top component 901A as in a conventional crusher as shown in FIG. 20. Instead; every component of the stationary casing 70 is positioned below the movable casing 80, i.e., it is positioned entirely below the movable casing 80.

One of two sets of inspection windows 720 and 721 or 722 and 723 are provided on each of the side components 72 on the stationary casing side such that an operator can open them to confirm the size of gaps C1 to C3, the wear state of stroke plate 322 or first or third impact plates 331 to 333, or clogging of crushed pieces in the drain at the bottom of casing 31. Any size or number of inspection windows can be arbitrarily selected for this embodiment.

In side component 72 on the stationary casing side, as illustrated in FIG. 4, upper end 724 (marked in broken lines) provides different levels comprising: first horizontal component 724A at the highest level; slanted component 724B sloped downward toward the far end from the feeding port 31A; and second horizontal component 724C at the lowest level. Upper end 724 is fitted such that movable casing 80 covers the entire area of the upper side for stationary casing 70, as a result, in the state illustrated in FIG. 4; upper end 724 is positioned below upper end 820 (crest line) of movable casing 80.

Figure 7:
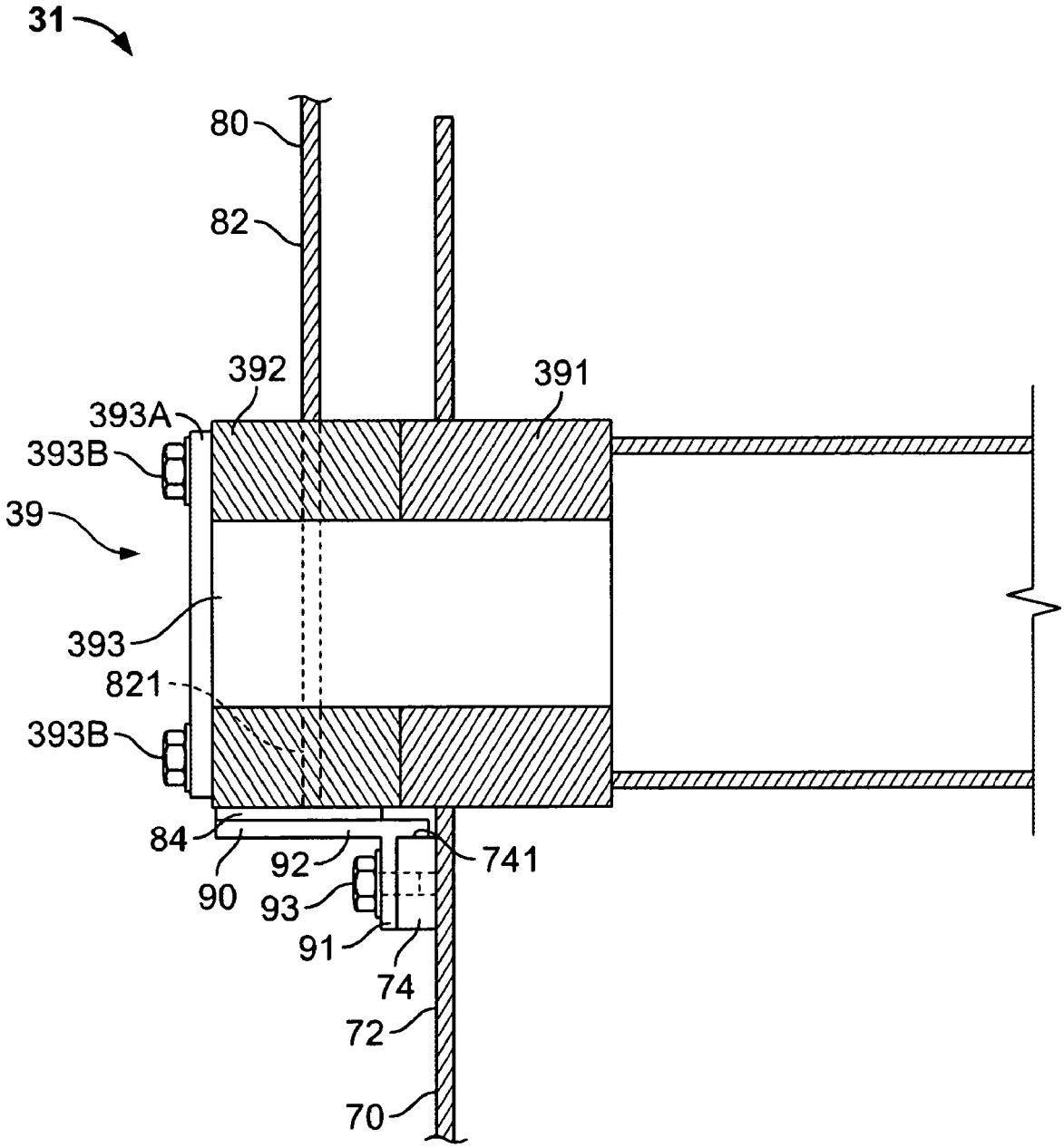
FIG. 7 is a cross sectional view showing a major section of the casing of FIG. 4 taken along the lines VII-VII in FIG. 4.

Above upper end 724 toward rear component 73, that is the opposite side of feeding port 31A for casing 31 but upper side of the entire casing 31 is provided rotation mechanism 39, which turns movable casing 80 around its shaft. As illustrated in FIG. 7, rotation mechanism 39 comprises: cylindrical component 391 on the stationary casing side attached on stationary casing 70; cylindrical component 392 on the movable casing side located outside cylindrical component 391 on the stationary casing side; and casing-support pin 393 to be inserted into cylindrical components 391 and 392. The flange component 393A of casing-support pin 393 is fixed onto cylindrical component 392 on the movable casing side with bolt 393B. Movable casing 80 turns around casing-support pin 393, which acts as a rotation shaft.

Now, as is illustrated in FIG. 4, stationary casing 70 and movable casing 80 are linked together by hydraulic cylinder 394 somewhat toward feeding port 31A from rotation mechanism 39. As movable casing 80 is turned, hydraulic cylinder 394 is actuated to assist heavily loaded movable casing 80 turning further around the casing support pin 393. Hydraulic cylinder 394 is arranged above its rod to prevent the rod end of the cylinder from dust-accumulation. The life of the packing seal and the like is thus improved.

Figure 8B:
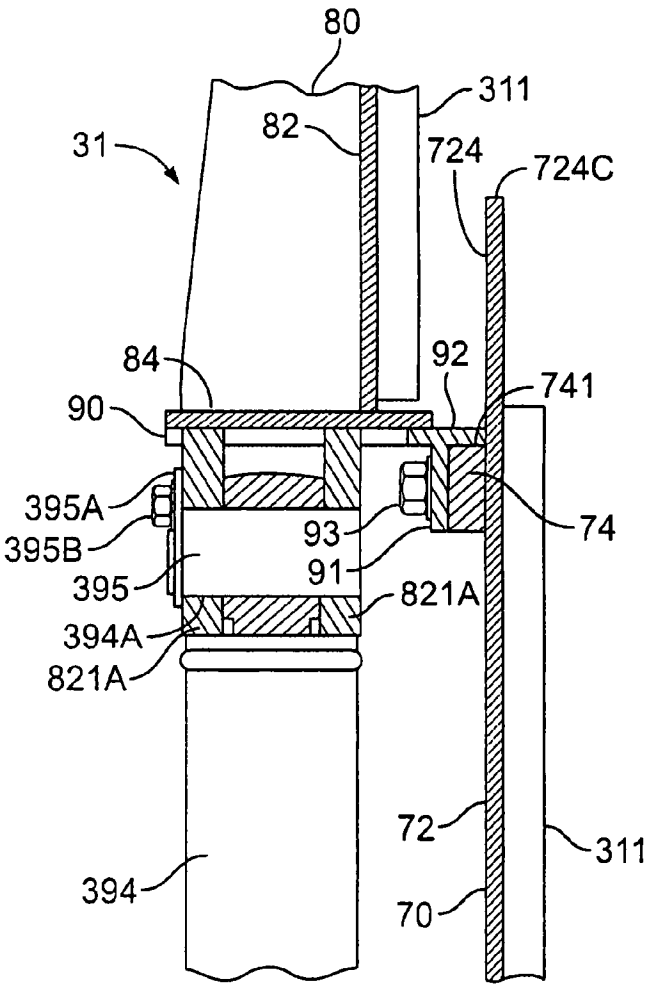
FIG. 8(B) is a cross section of the same.
Figure 8A:
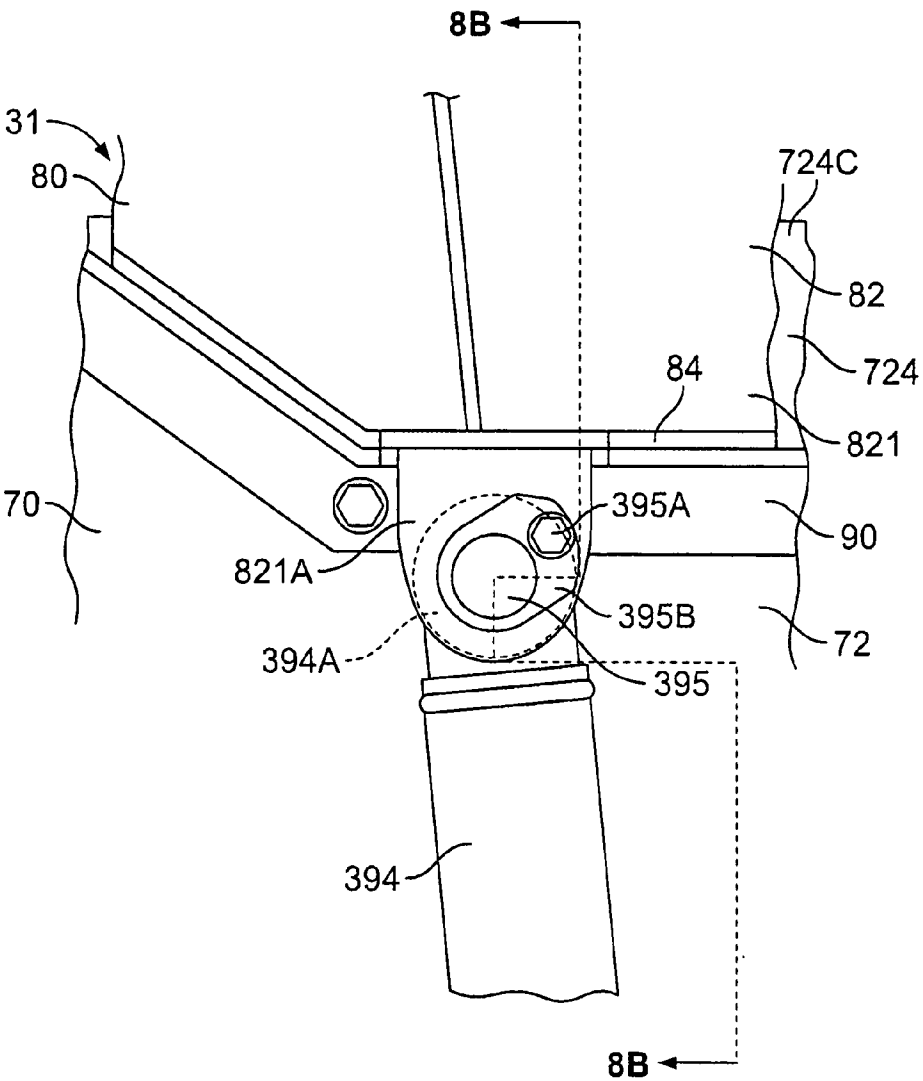
FIG. 8(A) is a side view of another major section of the casing of FIG. 4.

FIGS. 8(A) and (B) illustrate the linkage between the hydraulic cylinder 394 and the movable casing 80. As shown in these figures, two coupling pieces 821A projecting downward are provided at the lower end 821 of movable casing 80. Ring component 394A of hydraulic cylinder 394 is inserted between coupling pieces 821A, with cylinder pin 395 being inserted there through. Cylinder pin 395 is fixed onto coupling pieces 821A with a single bolt 395B, which passes through flange component 395A.

FIGS. 7 and 8(B) illustrate that the inner surface of stationary casing 70 is provided with a metallic liner 311 in a tensioned manner to protect the inner surface from bombardment of crushed pieces. Liner 311 of this construction is fixed thereto with external bolts or the like that pass through side component 72 on the stationary casing side. However, the part toward the front from the first to third impact plates 331 to 333 (as shown from the rear side) has little chance of receiving crushed pieces, even though it is within the inner surface of stationary casing 70, and therefore has no liner 311. Where there is a concern that crushed pieces can collide on the inner surface of movable casing 80, liner 311 is provided in a tensioned state as a matter of course.

As shown in FIGS. 6 and 7, immediately below upper ends 724 of both side components 72 on the stationary casing side in stationary casing 70 are provided mounting components 74 on the stationary casing side projecting outward along upper ends 724. Mounting component 74 of the stationary casing side is formed by attachment with another member to serve as a member to which intermediate fixture 90 is attached, a reinforcement to side component 72 on the stationary casing side of the thin-plate type, and a thickness enhancement to side component 72 of the stationary casing side to tightly screw the screw component of bolt 93 used for fixing intermediate fixture 90.

In contrast, as shown in FIGS. 4 and 6, movable casing 80 is constructed like a lid comprising top component 81 covering the opening on top of stationary casing 70; and side components 82 of the movable casing side are formed perpendicular to the horizontal sides of top component 81. The rear end of movable casing 80 constitutes a part of feeding port 31A.

The component of movable casing 80 that constitutes feeding port 31A projects more toward the feeding components 40 side where materials to be crushed are fed than in the conventional casing 900 (FIG. 20) and this projection is integral with movable casing 80 to provide eave component 83 (FIG. 4).

Casing 31 of this embodiment is larger than conventional casing 900, having a greater height and greater open area for feeding port 31A. For this reason, large materials to be crushed can be charged into feeding port 31A but crushed pieces can easily be snapped out of feeding port 31A. Therefore, eave component 83 extending toward feeder 42 is provided to catch crushed pieces. Snapping of crushed pieces is thus effectively prevented.

Moreover, as illustrated only in FIG. 4, iron chain 831 and rubber suspension member 832 having a curtain-like appearance are suspended from eave component 83 to ensure prevention of snapping of crushed pieces out of casing 31.

Top component 31 of movable casing 80 constructed in the abovementioned manner opens gradually toward feeding port 31A to provide a wider opening. Also, as illustrated in FIG. 5, a pair of insertion holes 81A, into which first and second gap adjustment devices 61 and 62 are inserted, is drilled. Drive component 63 is attached to each first and second gap adjustment devices 61 and 62 around insertion holes 81A.

Side component 82 of the movable casing side is positioned outside side component 72 of the stationary casing side, and the lower end 821 of side component 82 of the movable casing side receives and houses the upper end 724, which is above side component 72 of the stationary casing side. In other words, in casing 31 of this embodiment, upper end 724 and lower end 821 overlie each other in the horizontal direction. The separation line S-S for separating stationary casing 70 from movable casing 800 is drawn along this overlying portion.

Figure 9:
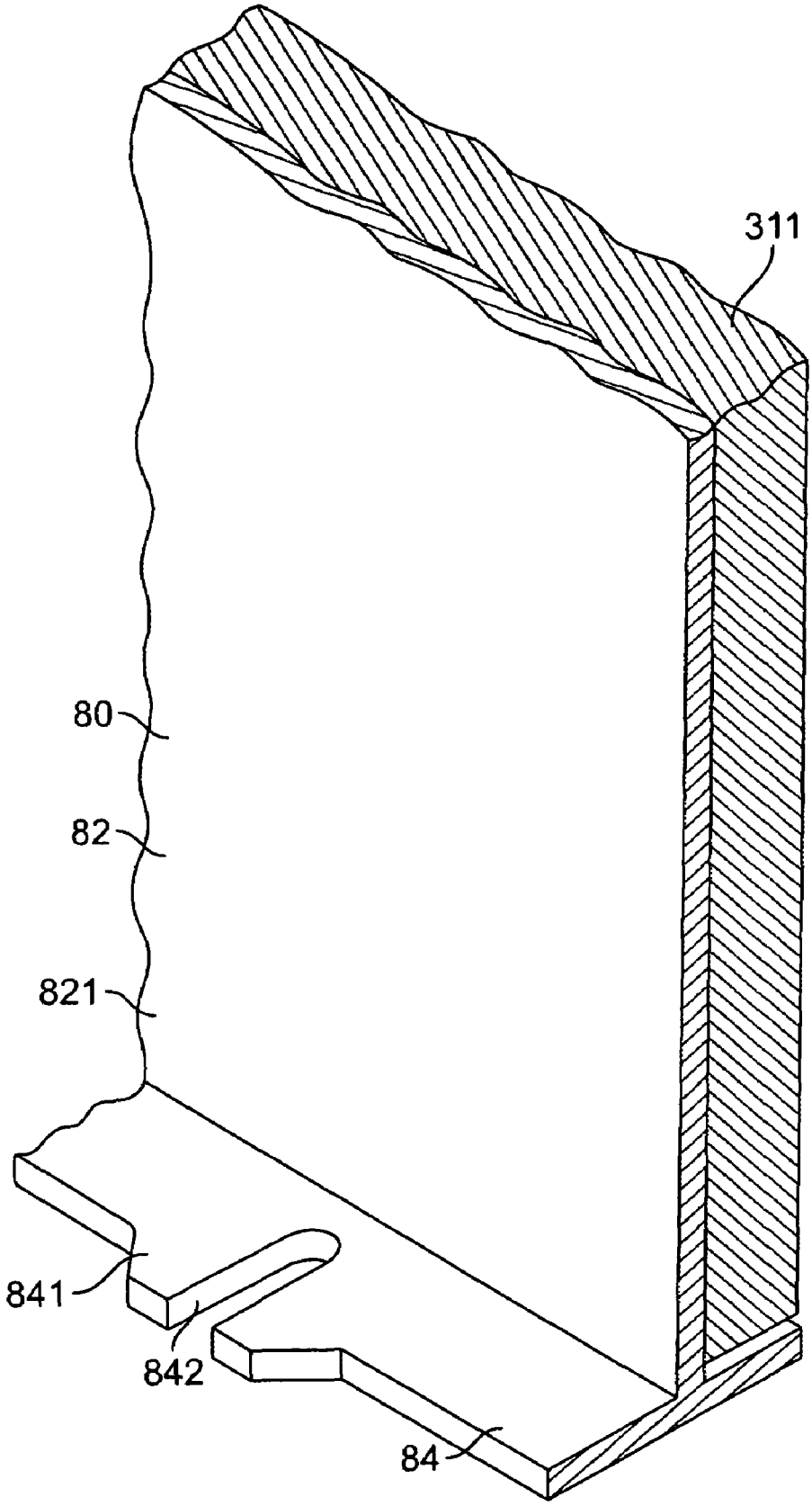
FIG. 9 is a perspective view showing a major section of the movable casing of FIG. 4.

As shown in FIG. 9, the lower end 821 portion of side component 82 on the movable casing side is provided with mounting component 84 on the movable casing side that is leveled along lower end 821. Mounting component 84 on the movable casing side comprises extension component 841 extending outward in the horizontal direction at a given point therein and notch component 842 in a long-hole shape is drilled on extension component 841.

Description of Mounting Structure, Circular Motion and Positions

In casing 31 for crusher 30, movable casing 80 is fitted to stationary casing 70 via intermediate fixture 90.

Intermediate fixture 90 is a continuous member, as illustrated in FIGS. 4 and 6, flexed along upper end 724 of side component 72 on the stationary casing, and constructed with perpendicular component 91 and horizontal component 92 to provide a "T" shaped cross section.

Figure 10:
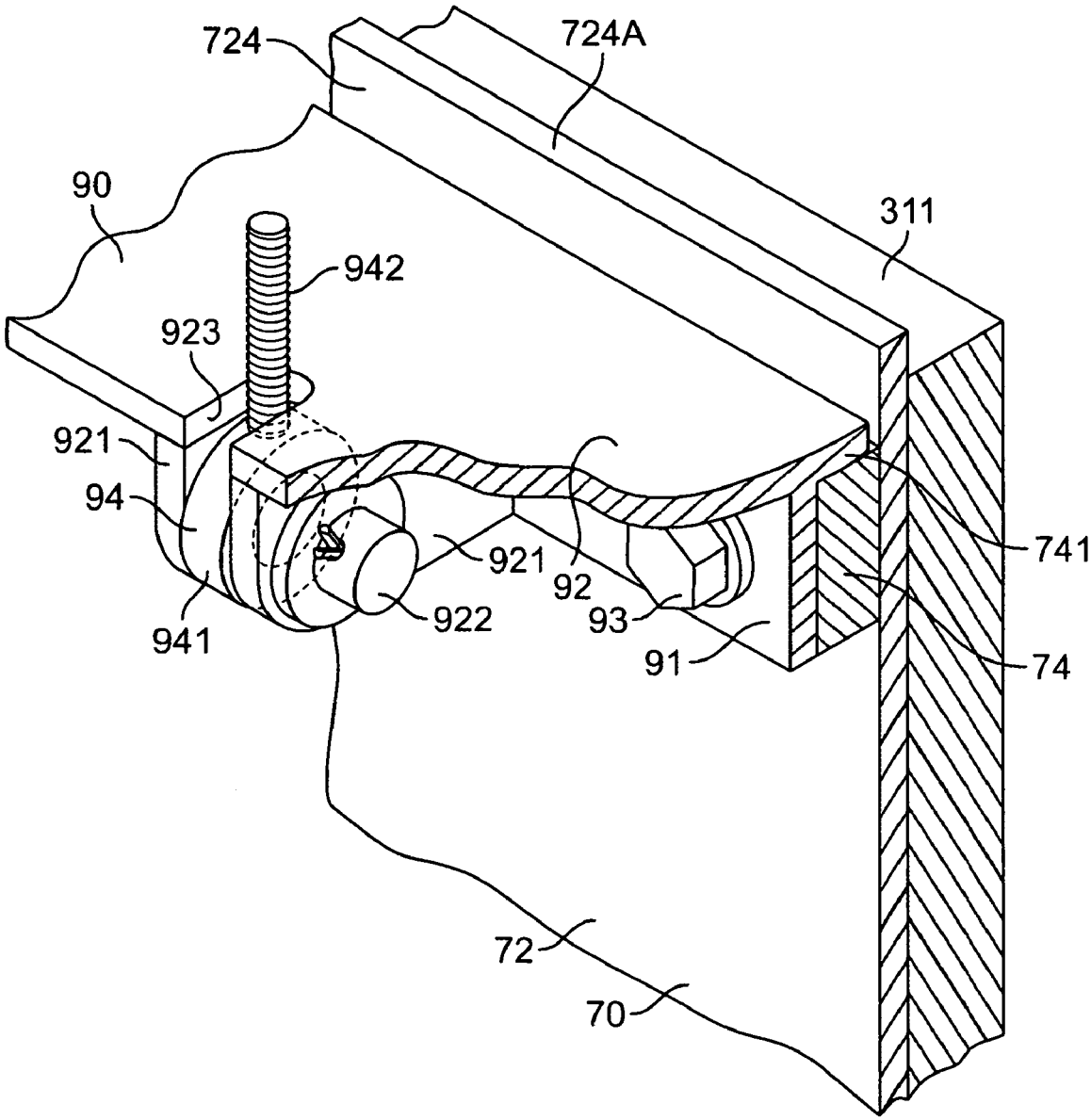
FIG. 10 is a perspective view showing the intermediate fixture used for the casing of FIG. 4.
Figure 11:
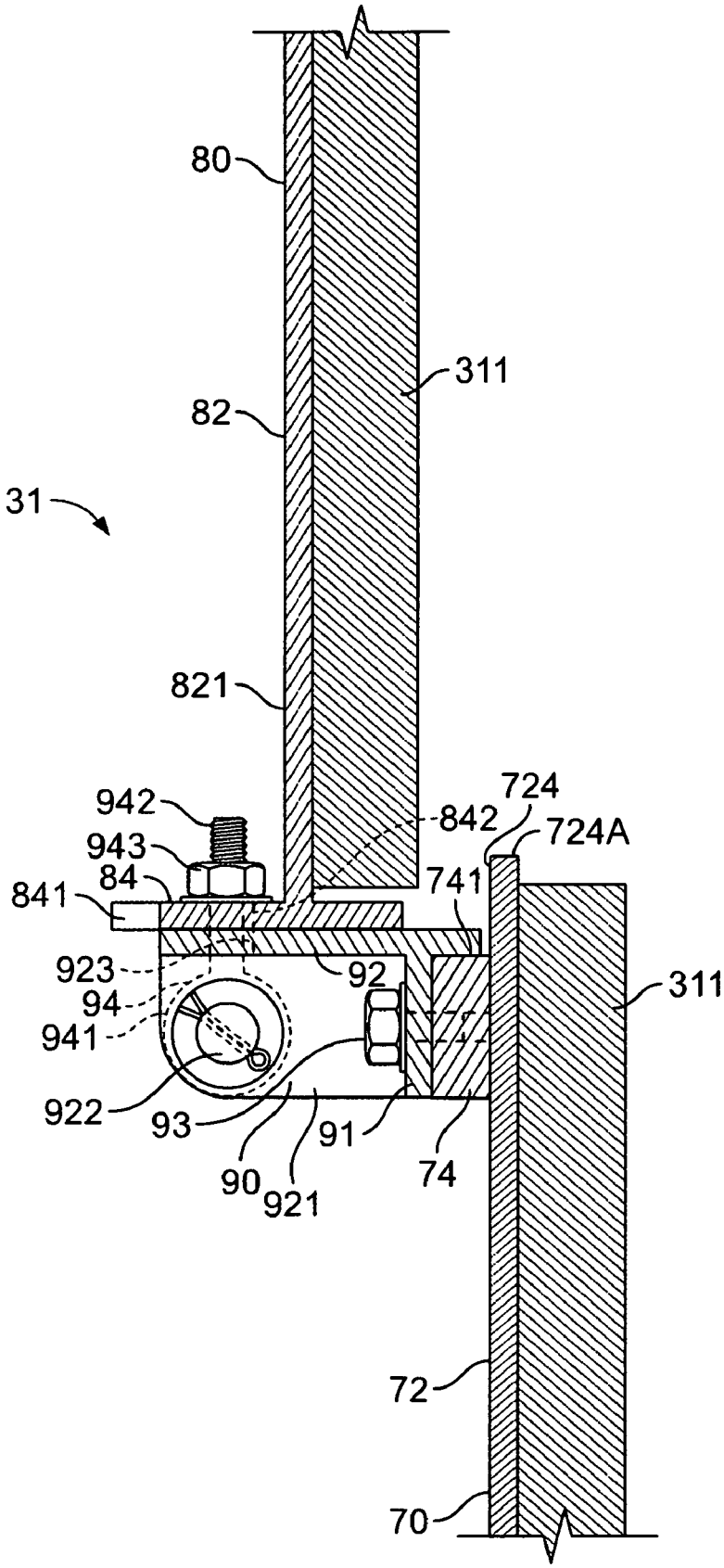
FIG. 11 is a cross section showing the holing component of the stationary casing and movable casing of the crusher of FIG. 1.

Also in FIGS. 10 and 11, intermediate fixture 90 is fixed onto mounting component 74 on the stationary casing side provided on side component 72 on the stationary casing side with bolt 93 which passes through perpendicular component 91. One end of horizontal component 92 is placed on receiving component 74, which is the top of mounting component 74 on the stationary casing side.

The inner end of mounting component 84 on the movable casing side is positioned more toward the outside than the outer end of mounting component 74 on the stationary casing side. Therefore, when horizontal component 92 for intermediate fixture 90 is displaced from receiving component 741, the entire movable casing 80 collapses downward, and further receives and houses the upper side of the stationary casing 70.

As illustrated in FIG. 11, the point on horizontal component 92 of intermediate fixture 90 that corresponds to notch component 842 (FIG. 9) of mounting component 84 on the movable casing, eyebolt 94 is rotatably fitted. Ring component 941 of eyebolt 94 is arranged between two supporting pieces 921 below horizontal component 92. Shaft member 922 being supported between supporting pieces 921 is inserted through ring component 941. The entire eyebolt can thus turn around shaft member 922. As eyebolt 94 turns while screw component 942 points upward, screw component 942 goes into notch component 923 of horizontal component 92, projecting perpendicularly to horizontal component 92.

On top of this horizontal component 92, mounting component 84 on the movable casing side of movable casing 80 is mounted. Being loaded with mounting component 84 on the movable casing side, screw component 942 of eyebolt 94 goes in as far as notch component 842 of mounting component 84 on the movable casing side, where it mates with nut 943 to couple mounting component 84 on the movable casing side with intermediate fixture 90, thereby holding the entire movable casing 80 above intermediate fixture 90.

The state that intermediate fixture 90 holds movable casing 80 is illustrated in FIG. 4 is the position when movable casing 80 crushes materials. In this position, materials to be crushed are charged into feeding port 31A and crushed. Therefore, movable casing 80 is normally maintained in this operating position.

Figure 12:
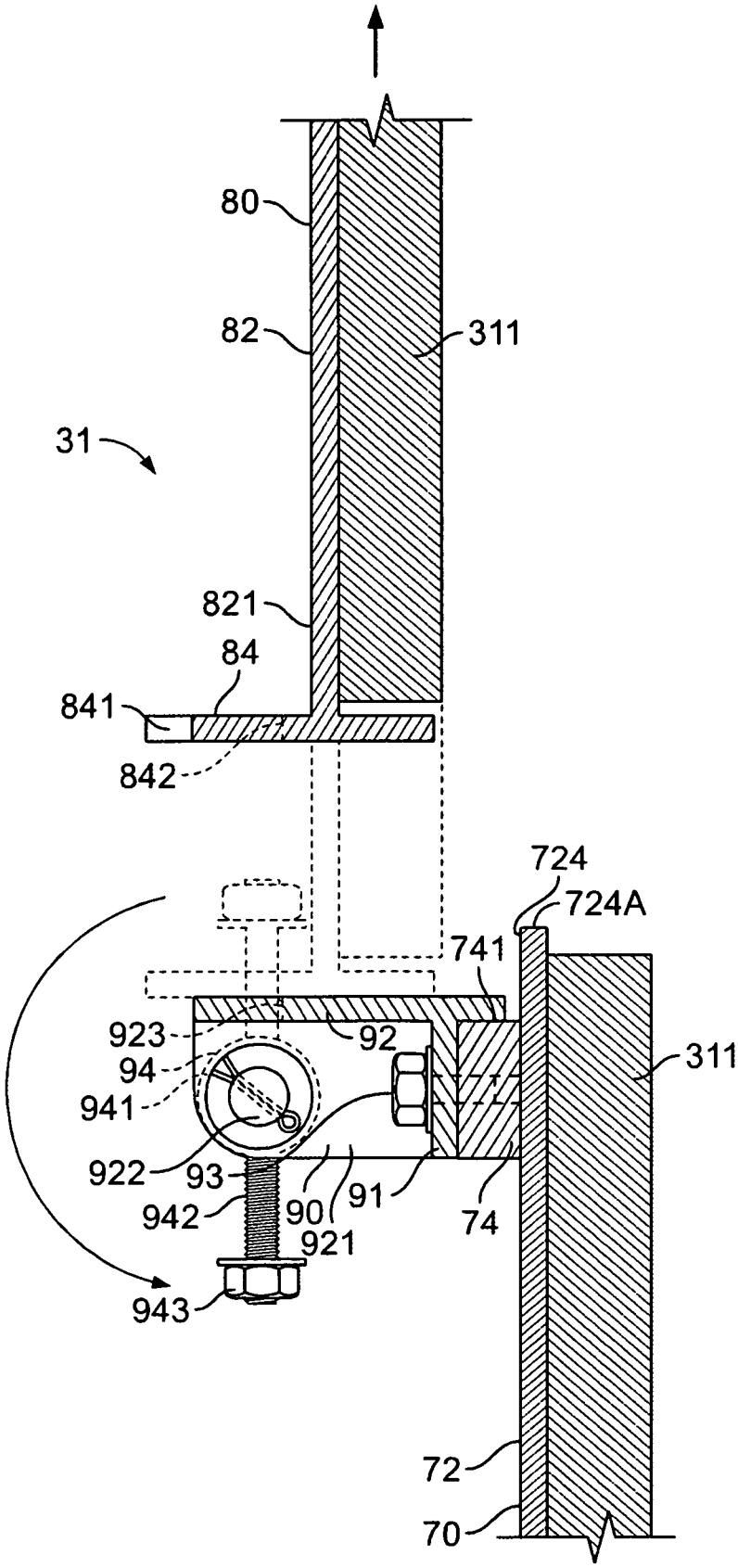
FIG. 12 is a cross section describing how the movable casing of FIG. 4 is opened.
Figure 13:
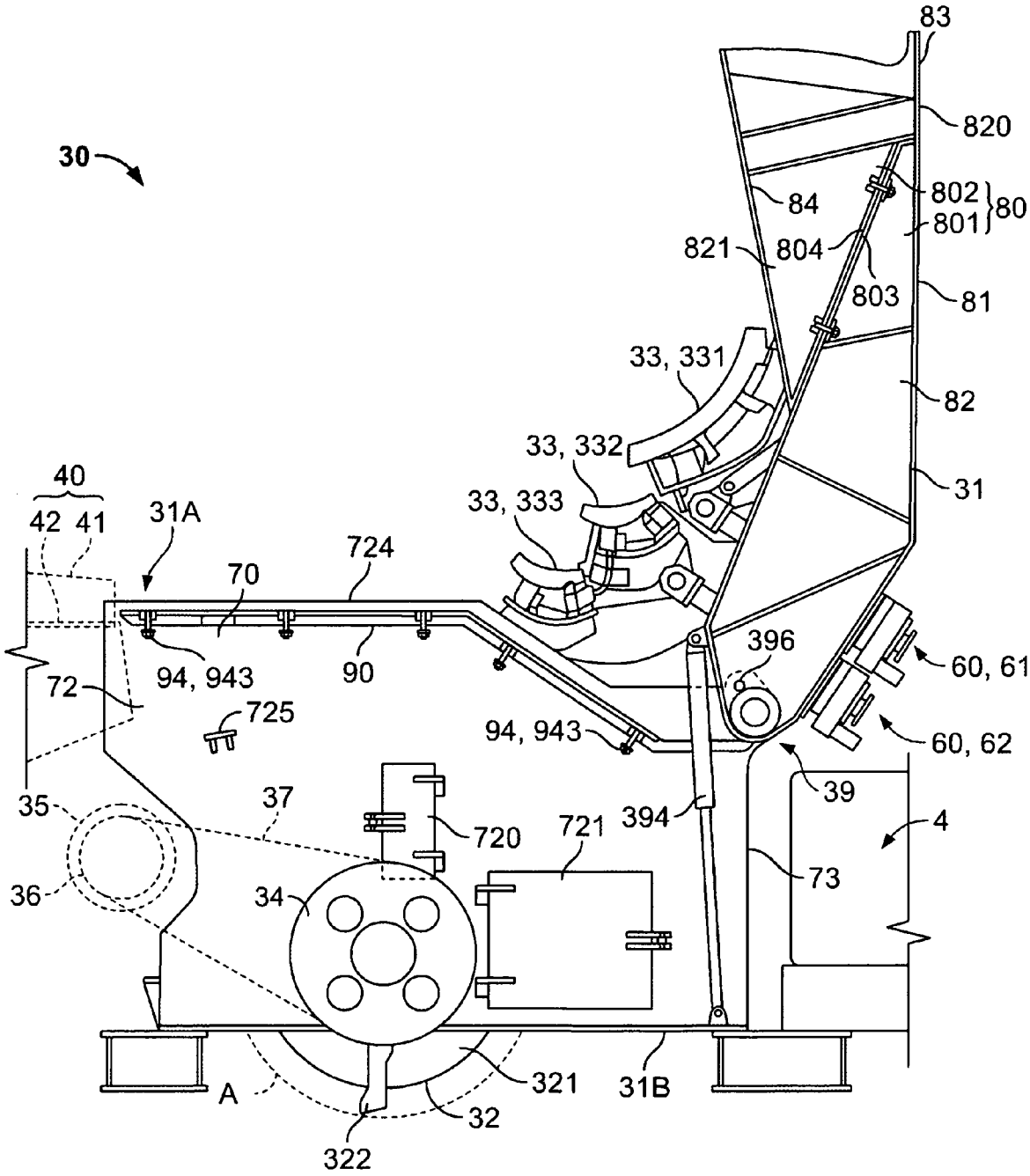
FIG. 13 is a side view showing the movable casing of FIG. 4 in the maintenance service position.

Next, how movable casing 80 is opened upward is described herein with reference to FIGS. 12 and 13.

To open movable casing 80, an operator loosens nut 943 screwed into eyebolt 94 on intermediate fixture 90 and turns eyebolt 94 to let screw component 942 point downward as illustrated in FIG. 12. By doing this, screw component 942 is removed from notch component 842 toward movable casing 80 to release the coupling of movable casing 80 with intermediate fixture 90. Then, movable casing 80 is opened with the assistance of hydraulic cylinder 394.

FIG. 13 illustrates the upward-open state of movable casing 80. In this state, feeding port 31A is also divided into two and the entire area of upper end 724 of stationary casing 70 is exposed. In this state, first to third impact plates 331 to 333 are also completely exposed; therefore, insertion or removal of these in the horizontal direction is ensured without interruption from stationary casing 70.

In other words, the open state of movable casing 80, as illustrated in FIG. 13, is the position for maintenance service thereof.

Moreover, in this position for maintenance service, movable casing 80 turns around rotation mechanism 39. As a result, even if movable casing 80 is opened to its maximum extent, it does not protrude in front of stationary casing 70 very much. It is thus possible to arrange power component 4 close to rear component 73 for stationary casing 70.

Further, when movable casing 80 is at the position for maintenance service, lock pin 396 that goes through the overlapping portion of stationary casing 70 and movable casing 80 near rotation mechanism 39 mechanically prevents movable casing 80 from unexpected closing.

Figure 14:
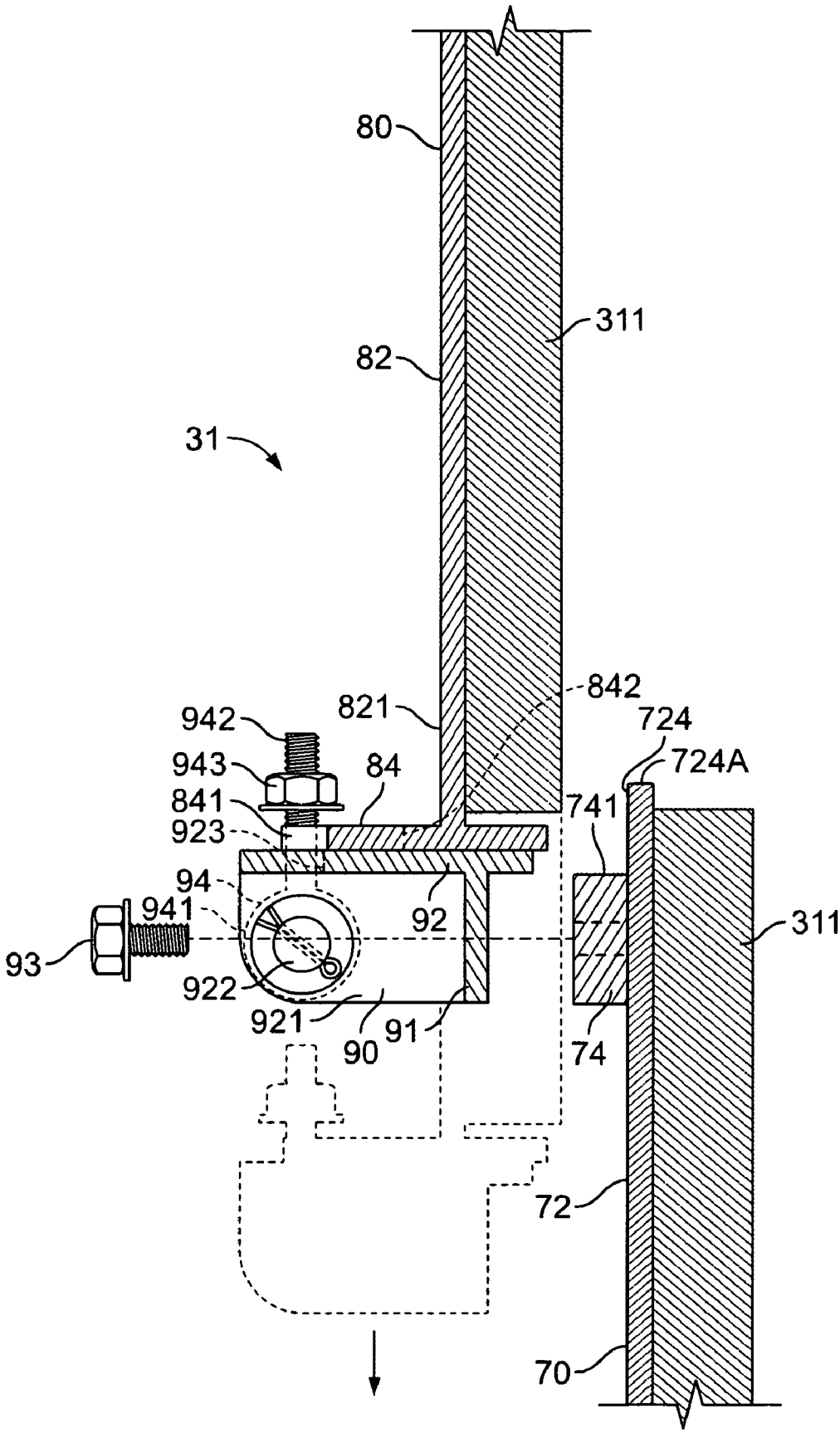
FIG. 14 is a cross section describing how the movable casing of FIG. 4 collapses.
Figure 15:
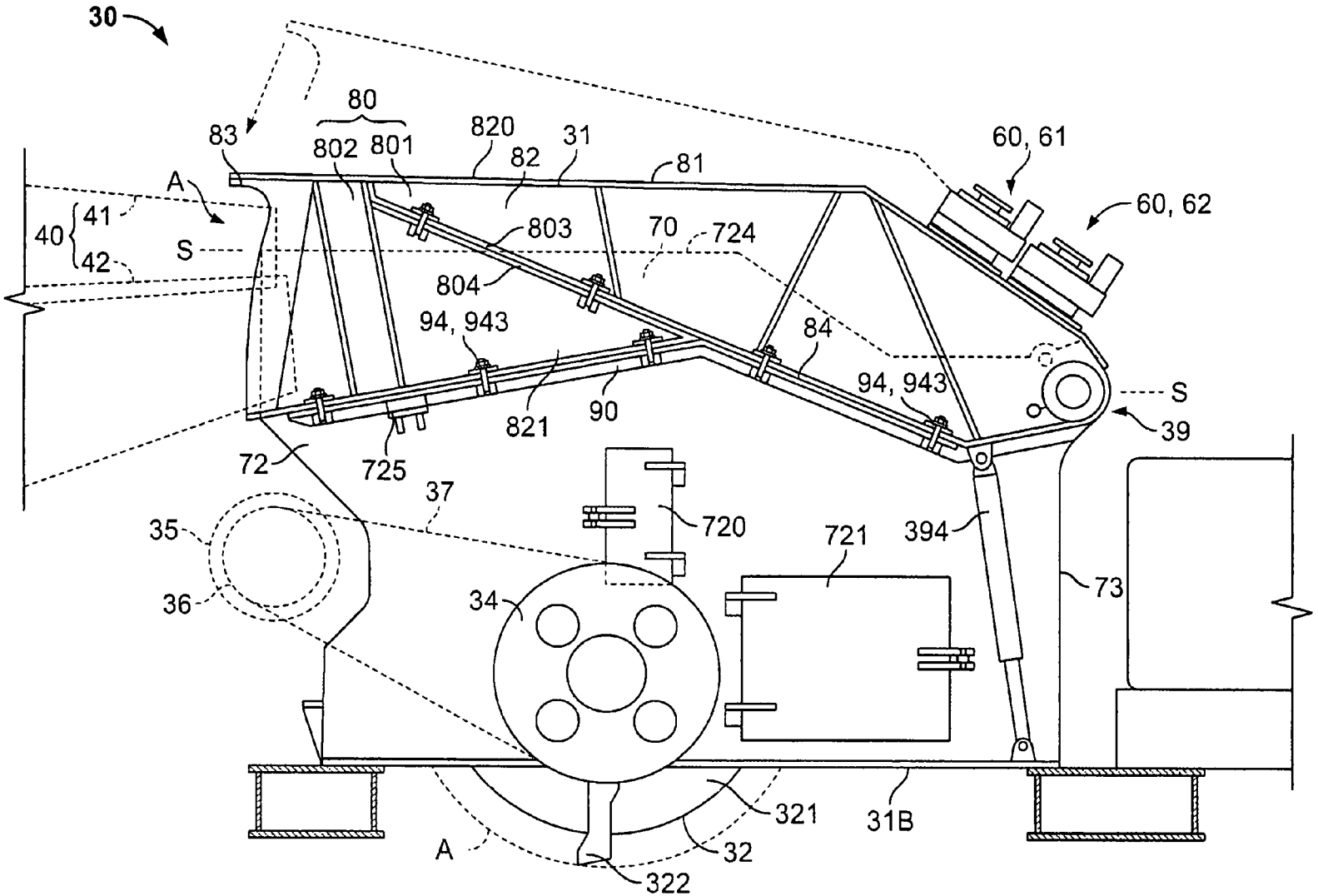
FIG. 15 is a side view showing the movable casing of FIG. 4 in a transporting position.

How movable casing 80 collapses downward is described herein with reference to FIGS. 14 and 15.

Movable casing 80 collapses downward by the following steps as illustrated in FIG. 14: removing bolt 93 from intermediate fixture 90; loosening nut 943 screwed into eyebolt 94; sliding intermediate fixture 90 farther from mounting component 74 on the stationary casing side in the horizontal direction; and removing horizontal component 92 of intermediate fixture 90 from receiving component 741 on mounting component 74 on the stationary casing side.

When intermediate fixture 90 slides, hydraulic cylinder 394 is actuated to slightly push up movable casing 80 together with intermediate fixture 90 such that intermediate fixture 90 does not carry the weight of movable casing 80. In addition, the extent to which an operator slides intermediate fixture 90 is that screw component 942 of eyebolt 94 is not displaced from notch component 84 on mounting component 84 on the movable casing side. After sliding intermediate fixture 90, the operator tightens nut 943 to some degree and fit intermediate fixture 90 to the extent that intermediate fixture 90 does not fall off from mounting component 84 on the movable casing side.

Then, as marked with two dotted lines in FIGS. 14 and 15, movable casing 80 toward feeding port 31A slowly collapses downward with the assistance of hydraulic cylinder 394.

Now, mounting component 74 on the stationary casing side and mounting component 84 on the movable casing side are, as described above, arranged such that they do not interfere with each other. Therefore, even if movable casing 80 collapses, mounting component 84 on the movable casing does not contact mounting component 74 on the stationary casing side.

FIG. 15 illustrates movable casing 80 collapsed downward. In this state, the top of side component 72 on the stationary casing side of stationary casing 70 collapses into movable casing 80 such that upper end 820 of movable casing 80 is about parallel to upper end 724 of stationary casing 70. For this reason, the total height of casing 31 becomes greatly reduced than that of the abovementioned operating position.

In other words, the collapsed state of movable casing 80, as illustrated in FIG. 15, is the position suited to clear any height limitation during its transportation.

When movable casing 80 is in the transporting position, mounting component 84 on the movable casing side of movable casing 80 contacts contacting component 725 provided on side component 72 on the stationary casing side. This contacting component 725 receives the weight of movable casing 80, maintaining excellent transporting position. The edges of hopper 41 and feeder 42 are received and housed into feeding port 31A but are positioned low enough that they do not contact movable casing 80 even though feeding port 31A narrows as movable casing 80 collapses.

Movable casing 80 can take positions comprising the crushing position, maintenance service position, and transporting position. It can also take the liner exchanging position. This liner exchanging position is described herein.

Figure 16:
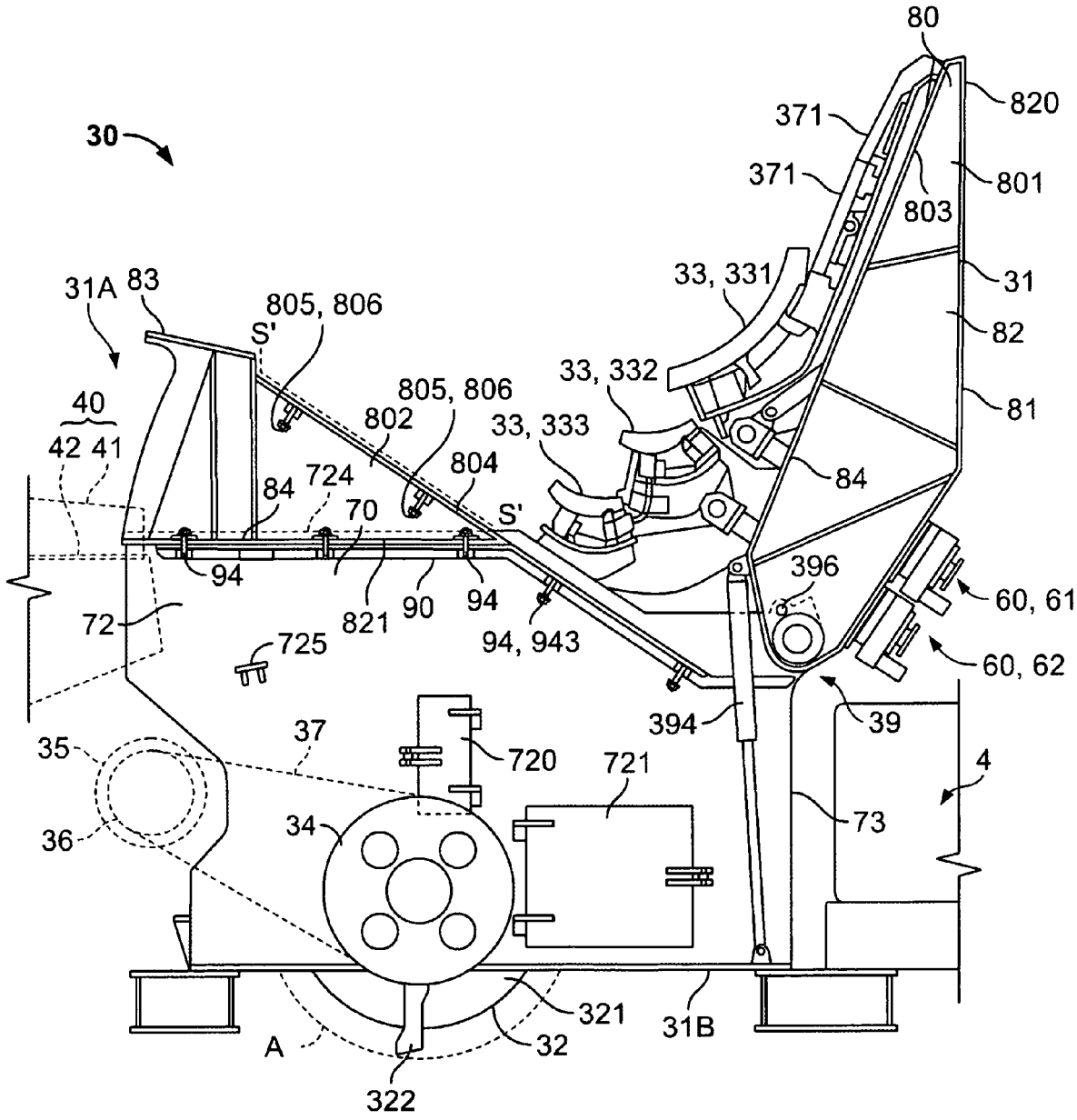
FIG. 16 is a side view showing the movable casing of FIG. 4 in the liner exchanging position.

In FIG. 16, movable casing 80 can be separated from movable casing 801 on the turning side, turning integral with first to third impact plates 331 to 333, and movable casing 802 toward feeding port 31A (See FIG. 6). Movable casing 801 on the turning side opens while maintaining movable casing 801 on the feeding port side mounted onto stationary casing 70, along separation line S'-S' as a border.

In other words, when movable casing 801 on the turning side is open, eyebolt 94 toward stationary casing 70 is displaced there from. However, movable casing 802 on the feeding port side and stationary casing 70 is still fitted by means of another eyebolt 94.

The structure of coupling movable casing 801 on the turning side with movable casing 802 on the feeding port side is basically the same as that of contacting conventional flanges. On movable casing 801 on the turning side, flange component 803 on the turning side, which is an extension of mounting component 84 on the movable casing side is provided. Movable casing 802 on the feeding port side is provided with flange component 804 on the feeding port side with eyebolt 805 fixed thereto. Flange components 803 and 804 are mutually hooked together by first turning eyebolt 805 to hook eyebolt 805 to flange component 803 on the turning side, and then by tightening nut 806 being screwed together with eyebolt 805.

Where movable casing 80 described above is in the liner-exchanging position, liner 337 provided above first impact plate 331 is exposed in the horizontal direction. Also, in this position, liner 337 can easily be inserted or removed from side component 82 on the movable casing side. Note that first to third impact plates 331 to 333 may be inspected or exchanged in the liner-exchanging position.

Description of Transportation of Mobile Crusher

Figure 17:
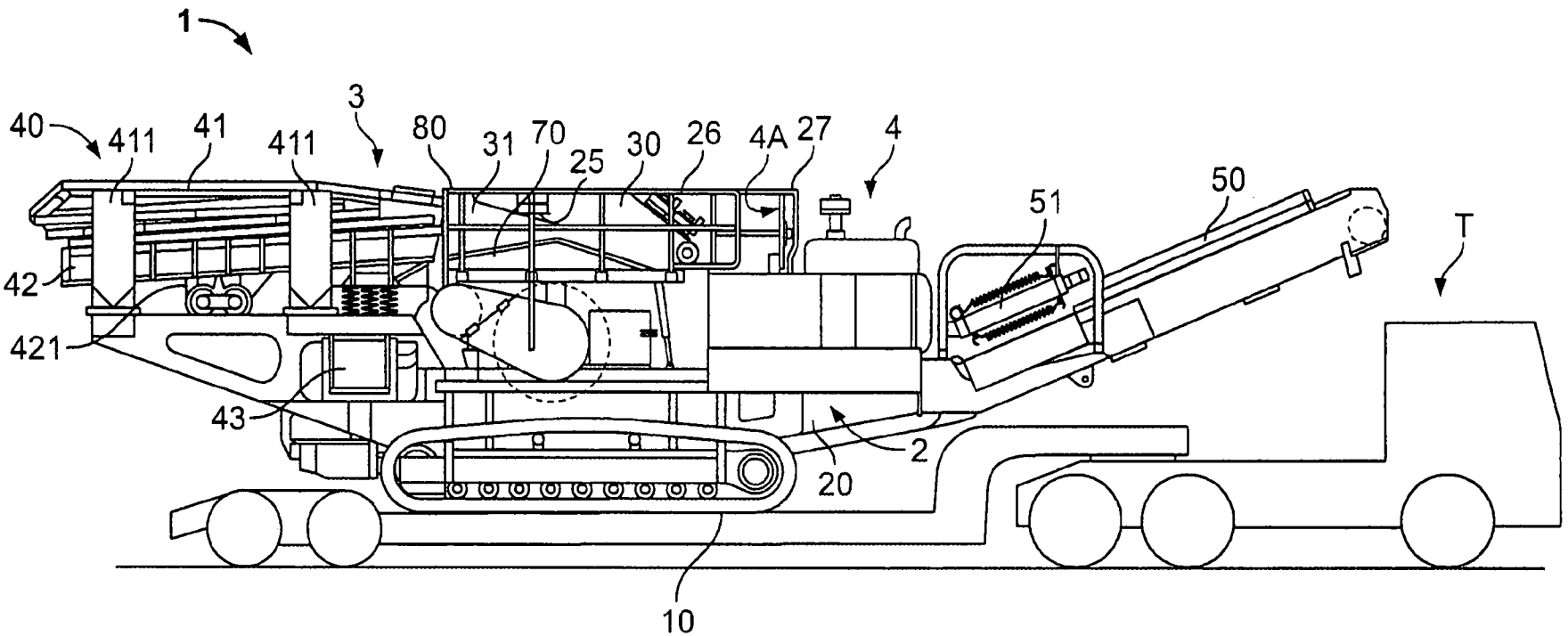
FIG. 17 is a diagram showing how the mobile crushing machine of FIG. 1 is transported without being disassembled.

FIG. 17 illustrates mobile crushing machine 1 loaded on trailer "T" to be transported.

In this state, movable casing 80 for crusher 30 takes the transporting position to clear the legal height limitation, in which movable casing 80 collapses in such a way that movable casing 80 receives and houses the top of stationary casing 70.

Revolving lamp 25, as illustrated in FIG. 1, which is higher than the height limitation imposed for transportation of a mobile crusher but has a simple structure is shifted downward or lowered by alternate means to clear the height limitation. Belt conveyer 43, under feeder 42, folds, thereby complying with the width limitation as well without being removed.

Figure 18:
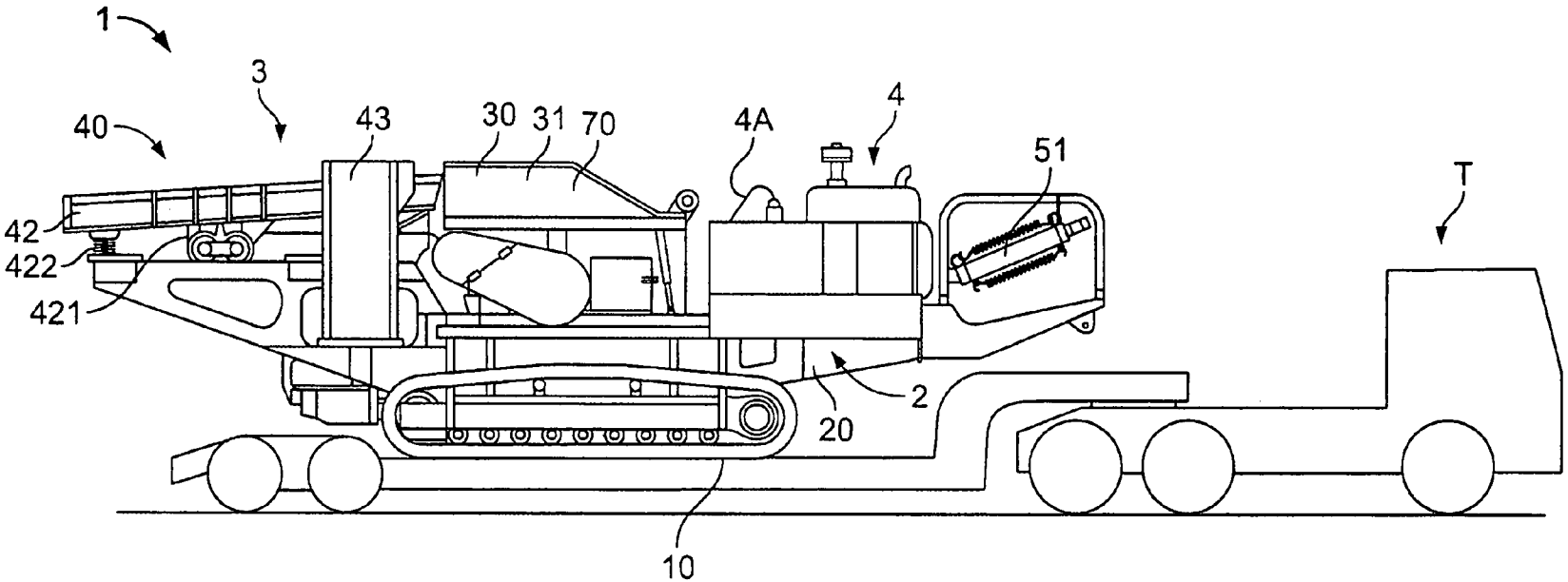
FIG. 18 illustrates how the movable crushing machine of FIG. 1 is transported when partially disassembled.

FIG. 18 illustrates a transportation mode required for clearing more stringent height limitation imposed on those passing under a land bridge with a short beam.

Figure 19:
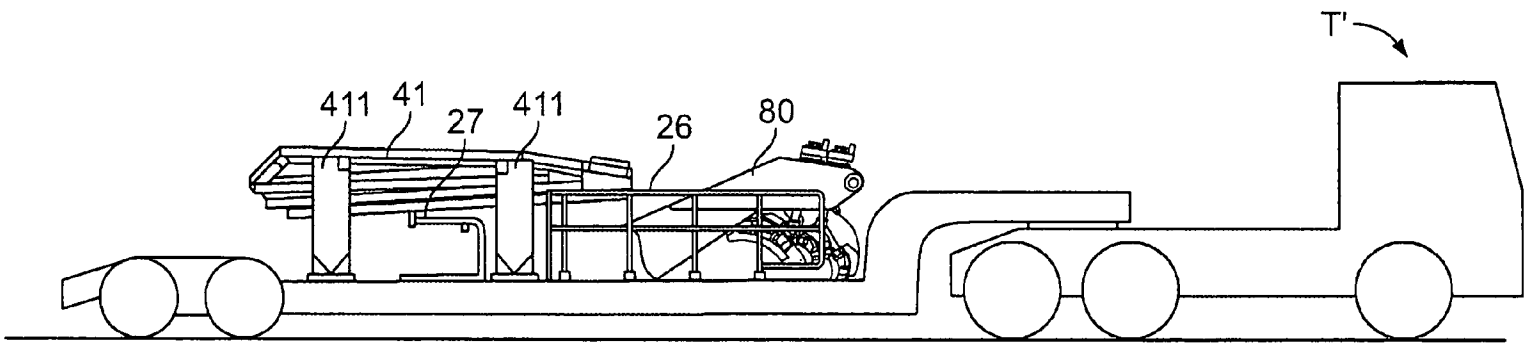
FIG. 19 illustrates how the disassembled components of the movable crushing machine of FIG. 1 are transported.

In other words, in mobile crushing machine 1 illustrated in FIG. 18, movable casing 80 is entirely removed from crusher 30 and is transported by another trailer T illustrated in FIG. 19. All one has to do to remove movable casing 80 from stationary casing 70 is to remove casing-support pin 303 illustrated in FIGS. 6 and 7, which is easy.

Other than the above, hopper 41, hand rails 26 and 27 around crusher 30, discharge belt conveyer 50 and the like can be transported by another trailer in a similar manner. Note that discharge belt conveyer is not illustrated in FIG. 19. Also note that traveling lever 4A is a toppling type and is pushed over therein.

As such, removing a part of mobile crushing machine 1 is effective in complying transport weight regulations.

The mobile crushing machine of the present invention has the following benefits:

(1) In the crusher 30 loaded onto mobile crushing machine 1, separable casing 31 comprises stationary casing 70 and movable casing 80. Separation line S-S is drawn such that upper end 724 of stationary casing 70 is positioned below upper end 820 of movable casing 80, and movable casing 80 is fitted such that it covers the entire opening on top of stationary casing 70. Therefore, when transporting mobile crushing machine 1, by trailer simply lowering the feeding port 31A side of movable casing 80 from the highest position downward reduces the overall height of casing 31, thereby meeting the height limitation.

(2) Even though crusher 30 in a large casing 31 is loaded, there is no concern on violating the height regulation during transportation via trailer, thereby promoting the use of crusher 30 of a larger capacity. A crusher 30 of a larger capacity significantly improves productivity.

Also, along with an increase in capacity of crusher 30 (Casing 31), the area of the opening for feeding port 31A can also be increased, which ensures feeding of materials to be crushed without clogging.

(3) Movable casing 80 in casing 31 is constructed to house and receive the top of stationary casing 70 therein. Therefore, only turning movable casing 80 by means of rotation mechanism 39 lets the feeding port 31A side collapse downward. The height of casing 31 can thus be made small without completely removing movable casing 80 from stationary casing 70.

(4) The mobile crushing machine 1 side in casing 31 can be further lowered by the steps comprising: removing casing-support pin 393 of rotation mechanism 39; removing the entire movable casing 80 from stationary casing 70; and removing hopper 41 and discharge belt conveyers and the like from frame 20. More stringent height regulations can thus be met.

Moreover, movable casing 80, hopper 41 and the like that are removed from mobile crushing machine 1 side, are not very tall. Another trailer can transport these components without concern of height regulations during transportation.

(5) To crush materials in crusher 30, an operator only sets movable casing 80 to the operating position to couple movable casing 80 with stationary casing 70. This avoids an unexpected collapse of movable casing 80 during crushing.

Also, during transportation of mobile crushing machine 1, contact component 725 firmly supports movable casing 80 being sunk, therefore, there is no concern of excessive lowering. A favorable transporting position is thus maintained.

In the maintenance service position, movable casing 80 being opened is firmly locked by means of lock pin 396, thereby rigidly retaining the maintenance service position to allow easy inspection or exchange of first to third impact plates 331 with 333. The same is true for the liner exchanging position in which movable casing 801 on the turning side of movable casing 80 is opened.

As described above, movable casing 80 can maintain an appropriate position that suits each operation, providing an easy-to-use feature to crusher 30.

(6) Eave 83 extending toward feeder 42 is formed integral with movable casing 80. Therefore, pieces of materials to be crushed that are snapped in casing 31 strike eave 83, preventing pieces of materials being crushed fly out of feeding port 31A.

In addition, presence of eave 83 eliminates a concern for material being crushed from flying out of casing 31. This allows designing a larger feeding port 31A. Materials to be crushed can thus be easily and readily charged.

(7) Chain 831 and suspension member 832 are suspended from eave 83, thereby ensuring prevention of materials to be crushed from flying out of casing 31. Materials to be crushed are thus crushed once they are charged.

(8) Rotation mechanism 39 for turning movable casing 80 is provided above the entire casing 31, allowing circular motion to take place at a higher position than casing 31. Therefore, little space is required for opening casing 31 in front of stationary casing 70 which is positioned below rotation mechanism 39. Power component 4 can be arranged closer to crusher 30 due to the saved space. The space is thus effectively utilized as a result of eliminating dead space.

(9) Arranging power component 4 toward crusher 30 allows reduction of the total length (front-to-rear length) of a mobile crushing machine 1, thereby making the entire mobile crushing machine 1 compact. Hence mobility, particularly maneuverability, is obtained for mobile crushing machine 1, ensuring operation even in a narrow work area.

(10) Rotation mechanism 39 is provided on the opposite side of and above feeding port 31A. As a result, when movable casing 80 is turned upward by a given angle, feeding port 31A opens wider toward the top, unlike the type having rotation mechanism 39 toward its bottom. Materials to be crushed can thus be fed into feeding port 31A more readily than in a crusher of conventional technology with little occurrence of clogging.

(11) When movable casing 80 is turned while rotation mechanism 39 is at an upper level, the feeding port 31A side draws an almost perpendicular locus. In other words, when movable casing 80 is moved up and down by a given amount, it moves with the minimal locus. This is particularly advantageous in that the collapsing motion quickly changes from the operating position to the transporting position by collapsing feeding port 31A or quickly returns from the transporting position to the operating position.

(12) Usually, feeding port 31A is provided toward the top of casing 31. If rotation mechanism 39 is provided on the feeding port 31A side as well, movable casing 80 may interfere with hopper 41 or feeder 42. To overcome this problem, hopper 41 or feeder 42 must have some evacuation measure requiring some space therein. The space for this measure, which is dead space when it is not used, requires a greater total length, possibly affecting the mobility of mobile crushing machine 1. In contrast, in this embodiment, rotation mechanism 39 is provided at the opposite side of feeding port 31A, eliminating the need for evacuation of hopper 41 or feeder 42. The space that could have been required for evacuation is thus eliminated, thereby reducing the overall length of mobile crushing machine 1.

(13) To set movable casing 80 in the transporting position, an operator removes intermediate fixture 90 from mounting component 74 on the stationary casing side. Since mounting component 74 on the stationary casing side and mounting component 84 on the movable casing side are positioned such that they do not interfere each other, uncoupling stationary casing 70 from movable casing 80 ensures downward collapse of movable casing 80 below stationary casing 70.

(14) Now, since stationary casing 70 and movable casing 80 are fixed by means of intermediate fixture 90, the gap between side component 72 on the stationary casing side and side component 82 on the movable casing side can be increased utilizing the space occupied by intermediate fixture 90 to enhance prevention of interference between mounting component 74 and 84 when movable casing 80 is sunk. Movable casing 80 thus collapses smoothly.

(15) In crusher 30, the gap between side component 72 on the stationary casing side and side component 82 on the movable casing side is large. Even if mounting component 74 and 84 are far apart, stationary casing 70 and movable component 80 can be continuously coupled together by utilizing intermediate fixture 90 in such a way that mounting component 84 on the movable casing side are intimately in contact through intermediate fixture 90 while mounting component 74 on the stationary casing side is also in intimate contact with intermediate fixture 90. An improved dust contamination prevention mode is thus obtained.

(16) Moreover, only intermediate fixture 90 is placed between stationary casing 70 and movable casing 80. The structure of the holding portion for holding movable casing 80 against stationary casing 70 is so simple that it does not require increasing the capacity of casing 31. As a result, the saved space can be used for transporting more pallets, which is an efficient way of using the space on a trailer.

(17) Horizontal component 92 of intermediate fixture 90 is held by receiving component 741 of mounting component 74 on the stationary casing side, therefore, intermediate fixture 90 and heavy movable casing 80 can be held by mounting component 74 on the stationary casing side. As a result, a large load of movable casing 80 does not act directly onto bolt 93 securing intermediate fixture 90, allowing the use of smaller bolt 93 for the same purpose. This makes mounting and removal operations easier.

(18) In addition, eyebolt 94 and nut 943, that are strong enough only to hold each other, can be adopted for mounting component 84 on the movable casing side and intermediate fixture 90. This eliminates the need for large fixtures for holding a large load from movable casing 80, thereby making mounting and removing operations easier.

(19) Removal of intermediate fixture 90 from stationary casing 70 is done in such a way that an operator slides intermediate fixture 90 along notch component 842 on mounting component 84 of the movable casing side to separate it from mounting component 74 on the stationary casing side. In contrast, fitting of intermediate fixture 90 onto stationary casing 70 is done by simply sliding intermediate fixture from a separated position to proximity of mounting component 74. In this way, intermediate component 90 can be easily attached or removed to or from stationary casing 70.

The present invention is not limited to the above embodiment. The following modifications that serve the purpose are also within the scope of the present invention.

For example, in the above embodiment, eave 83 is formed integral with movable casing 80 on the feeding port 31A side; however, a movable casing 80 without eave 83 is within the scope of claims except claim 4. Nonetheless, eave 83, which sticks out to the highest position when movable casing 80 is in the operating position, collapses downward when movable casing 80 is in the transporting position. Therefore, its height is not a concern in terms of height limitations. Taking the advantageous effect of (6) into account, it is desirable to have eave 83.

In the above embodiment, movable casing 80 can take the operating position, maintenance service position, transporting position and liner exchanging position.

Among these, the maintenance position and liner exchanging position may be eliminated depending on the inner structure of casing 31, more specifically, number, shape, and location of impact plates 33, arms 334 and 335, or type of crusher, if required.

In the above embodiment, movable casing 80 receives and houses the stationary casing 70 therein. Nevertheless, the present invention is not limited to this structure. For example, the lower side of movable casing 80 can be housed and received by stationary casing 70.

In the above embodiment, rotation mechanism 39 for turning movable casing 80 is provided on the opposite side of feeding port 31A. Nonetheless, the configuration having rotation mechanism 39 on the feeding port 31A side is also within the scope of claims except claim 6. Note that when rotation mechanism 39 is provided on the feeding port 31A side, the advantageous effects of above (12) cannot be obtained. Hence, it is desirable that rotation mechanism 39 be provided on the opposite side of feeding port 31A.

Moreover, the rotation mechanism 39 may be provided on the lower side of the entire casing 31, as long as movable casing 80 is fitted on the upper side of stationary casing 70 and the upper end 724 of stationary casing 70 is below upper end 820 of movable casing 80 so as to collapse movable casing 80 into stationary casing 70.

To collapse movable casing 80 below stationary casing 70, other than using rotation mechanism 39 of the above embodiment, movable casing 80 may be made, for example, slidable such that it slides downward into stationary casing 70. Also, movable casing 80 can change its position step by step by fixing it onto stationary casing 70 with a bolt. In other words, mechanism for collapsing movable casing 80 into stationary casing 70 can be arbitrarily determined as required for reduction to practice.

Also, as illustrated in FIG. 20, even when separation line S-S is provided to separate casing 900 into two (right and left), the configuration is within the scope of claim 5 as long as the rotation mechanism is provided on the upper side of the entire casing 900.

Mobile crushing machine 1 of the above embodiment is a self-propelling machine equipped with crawler-type traveling component 10. The machine is not limited to a crawling type, but can be a wheel type. It is not limited to a self-propelling type but can be a hauling type. As long as the mobile crushing machine has a mobile configuration, it is within the scope of the present invention.

The mobile crushing machine 1 may include any crusher type for example, jaw-type crusher, share-type crusher, cone-type crusher, roller-type crusher and the like.

The crusher of the present invention is not limited to those loaded onto a mobile crushing machine 1 but can be of a stationary type installed at a specific crushing site. Even so, when there is a need for transporting the crusher for some reason, movable casing 80 can be set to the transporting position, meeting the height limitation during transportation.

Further, the present invention is not limited to the configuration of frame 20, feeding components 40 for materials to be crushed, discharge belt conveyer 50 and the like mentioned in the above embodiment. The present invention is not limited to specific shapes and the like of mounting component 74 on the stationary casing side, mounting component 84 on the movable casing side, intermediate fixture 90 in casing 31. These can also be modified arbitrarily to accomplish the objects of this invention.

Description of the Gap Adjustment Device

The gap adjustment feature of the present invention is a device 60 incorporated into the impact crusher for adjusting the gap between the stroke component and the impact plates.

A first and second gap adjustment device may be used configured in the same way and, for purposes of this invention, will simply be described as gap adjustment device 60.

Figure 21:
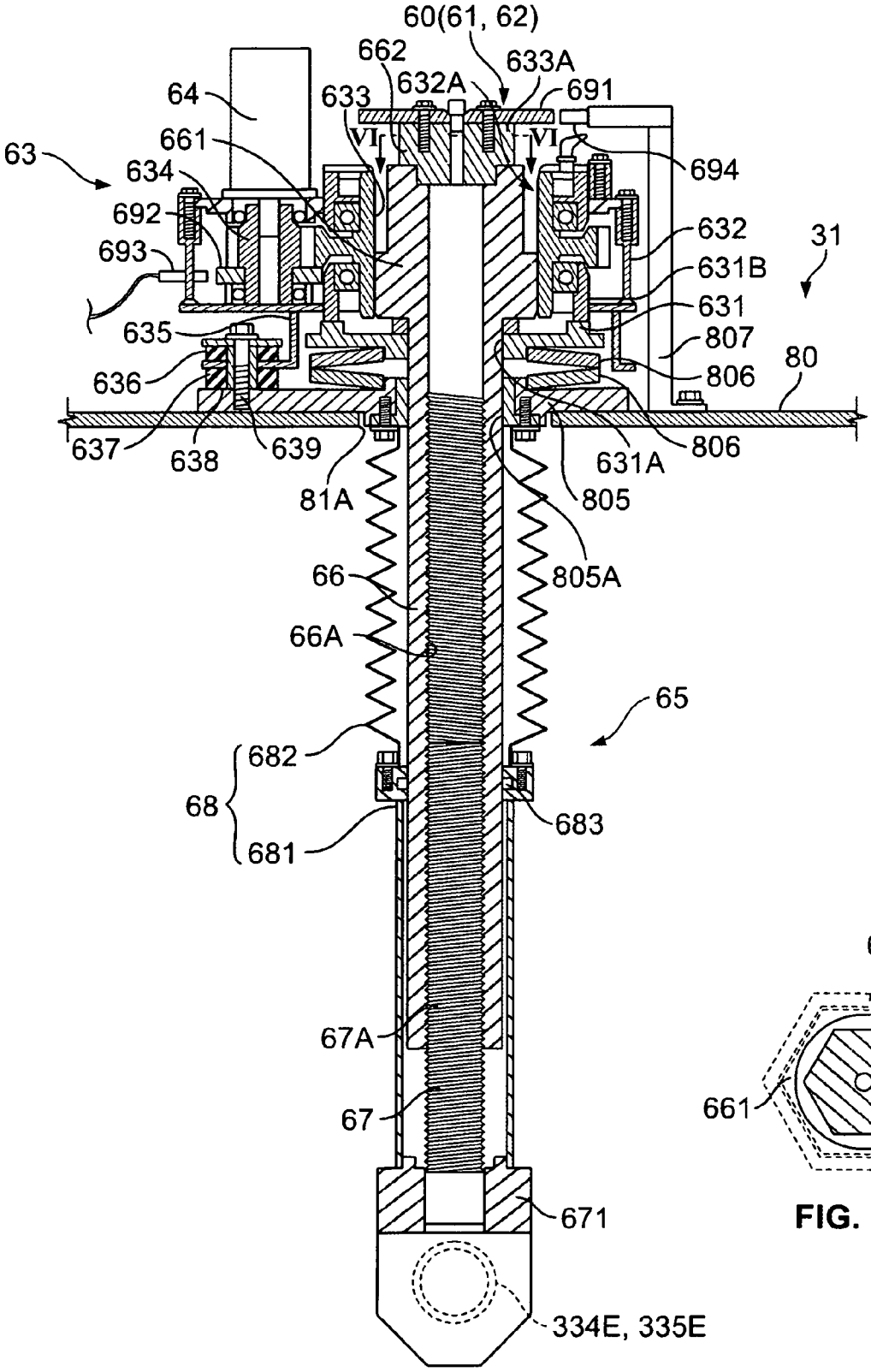
FIG. 21 is a cross sectional view showing the gap adjustment device in the mobile crushing machine shown in FIG. 4.
Figure 21A:
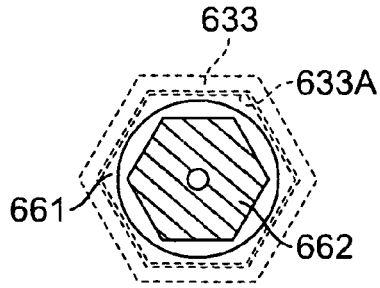

In FIGS. 5, 21 and 21(*a*), the gap adjustment device 60 comprises a drive component 63 and a rod-like forward-backward component 65 driven by drive component 63.

Drive component 63 is fitted via a pair of stacked flat springs 806 onto mounting seat 805 bolted on top of movable casing 80, and comprises pedestal 631 on flat springs 806. Through holes 81A and 631A, which are concentric with another through-hole 805, are drilled in pedestal 631, and through these through-holes is inserted forward-backward component 65.

Drive component 63 comprises armor casing 632 provided on pedestal 631. Armor casing 632 comprises housing component 632A for housing the upper end of forward-backward component 65 wherein cylinder gear 633 having a hollow component 633A of a hexagonal cross section is rotatably arranged in housing component 632A, as marked with two dotted lines in the VI-VI cross section in FIG. 6. As illustrated herein, mesh component 661 of a hexagonal plan view on forward-backward component 65 meshes with hollow component 633A of cylindrical gear 633 in such a way that as cylindrical gear 633 rotates, forward-backward component 65 rotates as well.

The cylindrical gear 633 meshes with gear 634 of a smaller size, which is linked to the rotation shaft of hydraulic motor 64. Therefore, hydraulic motor 64 drives and rotates forward-backward component 65. Revolution of hydraulic motor 64 is transmitted to forward-backward component 65 while its speed is slowed down between gear 634 and cylindrical gear 633. The mesh portion between cylindrical gear 633 and gear 634 is lubricated with lubricant oil injected into armor casing 632.

Armor casing 632 is fitted onto mounting seat 805 which is on movable casing 80, via mounting piece 635, having an L-shaped cross section at its bottom. The horizontal portion of mounting piece 635, pinched between a pair of rubber members 636 and 637 that are stacked as resilient members, is fitted thereon by means of sleeve 638 and bolt 639 through mounting piece 635, and rubber members 636 and 637.

Even though there is only one mounting portion as illustrated in FIG. 6, rubber members 636 and 637 are at the opposite ends, putting the rotational center of cylindrical gear 633 (forward-backward component 65) there between, such that drive component 63 is fitted to movable casing 80 at two points.

Forward-backward component 65 comprises nut member 66, which is the casing side member fitted towards movable casing 80, and bolt member 67, which is the impact plate side member whose bottom is fitted to link bars 334E and 335E toward impact plates 33, wherein screw component 67A is engraved onto bolt member 67 and screwed into screw component 66A engraved onto the inner surface of nut member 66.

On the upper end of nut member 66, there is the above-mentioned mesh component 661. In addition, operation component 662, which is hexagonal in its plan view but one size smaller than mesh component 661, is welded thereon utilizing another member or fitted by alternate means as shown in the horizontal cross sectional view in FIG. 6. An operator removes detection plate 691 bolted there above to insert a tool such as a box wrench or the like into operating component 661 to manually rotate nut member 66.

Bolt member 67 is fitted to link bars 334E and 335E via joint member 671 provided thereunder. Between joint member 671 and mounting seat 805 on the upper level, a covering member 68 is provided for covering the part of forward-backward component 65 inserted through casing 31.

Covering member 68 has a structure in which cylindrical component 681, at the lower level, fixed onto joint member 671 and bellow-like flexible component 682, at the upper level, fixed onto mounting seat 805 are linked together. The upper end of cylindrical component 681, which is the part that moves forward or backward with bolt member 67, is attached onto the circumference of nut member 66 via annular sealing member 683. Cylindrical component 681 and bolt member 67 have about the same length. Sealing member 683 is attached to the circumference of nut member 66 within the range (stroke) wherein bolt member 67 regularly moves forward or backward thereby preventing cylindrical component 681 from dust contamination or permeation of water.

Forward-backward component 65 is inserted into through holes 81A, 805A, 631A of movable casing 80 and drive component 63 and its weight is received by pedestal 631 for drive component 63 via nylon pad 631B. Hence, forward-backward component 65 is not fixed onto any component in its insert-direction: under an abnormal circumstance such as when large materials to be crushed burst on impact plates 33 or clog between impact plates 33 and stroke plate 322, mesh component 661 moves from pedestal 631 because the entire forward-backward component 65 is pushed up. However, forward-backward component 65 is not pushed up very often during crushing. It is a phenomenon observed only during an abnormal circumstance in the present invention and must be differentiated from the rod's bouncing, which occurs specifically when forward-backward component 65 is constructed with a hydraulic cylinder of conventional technology.

Note that forward-backward component 65 of the present invention freed from the pushed-up problem returns downward by the total weight of impact plates 33, first arm 334 and second arm 335 and the like while flat springs 806 absorb the impact from turning and the like.

According to gap adjustment device 60 described above, rotation of nut member 66 on forward-backward component 65 does not rotate bolt member 67 fitted thereon toward impact plates 33 but moves forward or backward in accordance with the number of revolutions and the rotational direction thereof. The forward-backward motion of the bolt member 67 swings impact plates 33 via first and second arms 334 and 335.

Control means (not illustrated) controls hydraulic motor 64 to move impact plates 33, thereby automatically adjusting gaps.

More specifically, gear 634 comprises a disk-like detection disk 692 having multiple notches in the circular direction; armor casing 632 comprises a revolution number detection sensor 693, which detects notches on detection disk 692 to output a detection signal every time these notches pass there through.

The control means computes the extent bolt member 67 moves forward or backward and the extent by which impact plates shift to rotate hydraulic motor 64 normally or in reverse until the number of revolutions reaches the desired numerical value that has been preset, based on the number the detection signal inputs from the revolution number detection sensor 693, while considering the deceleration rate between gear 634 and cylindrical gear 633, the pitch for mesh portion of the forward-backward component 65, the calibration coefficient and the like. A software program in the control means regulates the above process.

In other words, when one intends to increase the grain size of crushed materials, one inputs a desired number of revolutions such that impact plates 33 are distanced from stroke plates 322; when one intends to decrease the grain size of crushed materials, for example, one inputs a desired number of revolutions such that impact plates 33 come in proximity of stroke plate 322. Impact plates 33 move only by the number of revolutions that is input, thereby adjusting gaps C1 to C3 between impact plates 33 and stroke plate 322 without a spike.

As one continues moving bolt member 67 forward to move impact plates 33 toward impact plate 322, impact plates 33 finally contact stroke plates 322 or rotor body 321. At this stage, if one rotates hydraulic motor 64 to further move bolt member 67 forward under the circumstance, bolt member 67 does not go forward, but instead, nut member 66 is moved and pushed upwards. This occurs because the entire forward-backward component 65 is simply inserted but not fixed thereon.

To overcome this, in the gap adjustment device 60 of this embodiment, "push-up" detection sensor 694 fitted thereto via bracket 807 detects the position of detection plate 691 provided on top of bolt member 67 such that it can detect the push-up motion of forward-backward component 65. Output from push-up detection sensor 694 allows the control means side recognizes that impact plates 33 contacted stroke plates 322 or rotor body 321 and automatically station hydraulic motor 64.

The output from push-up detection sensor 694 is also used, for example, to set the "zero point" for impact plates 33.

In other words, when one increases the distance between the point at which impact plates 33 are located and revolution locus A for stroke plates 322 for a given numerical value to adjust gaps C1 to C3 between stroke plates 322 and impact plates 33, one moves impact plates 33 first to let them contact stroke plates 322 or rotor body 321, and then gradually returns them until they align with rotation locus A, which is set to the zero point for impact plates 33. This zero point setting is automated utilizing a program in the control means. It is the output from push-up detection sensor 694 that lets the control means recognize the contact between the stroke plates 322 and the impact plates 33 or between impact plates 33 and rotor body 321.

Note that clogging of materials to be crushed between impact plates 33 and stroke plates 322 also pushes up forward-backward component 65. The system can also detect clogging based on the output from push-up detection sensor 694. In this case, feeder 42 may be turned off to temporarily station charging materials to be crushed in crusher 30.

The gap adjustment device has the following advantageous effects:

(1) Gap adjustment device 60 installed in crusher 30 comprises forward-backward component 65 for moving impact plates 33. This forward-backward component 65 has a structure in which nut member 66 and bolt member 67 are meshed together, thereby providing a linkage for rotating the nut member 66 side by hydraulic motor 64. In this structure, impact plates 33 fitted onto the bolt member side can be moved without a spike only by rotating nut member 66 by a required number of revolutions in the normal or reverse direction. Adjustment of gap size C1 to C3 between stroke plates 322 and impact plates 33 is thus made easier and more desirably than the structure using a conventional hydraulic cylinder.

(2) Screw component 66A of nut member 66 and screw component 67A of bolt member 67 are screwed together. When impact plates 33 are in the stationary state, they do not move in the direction of motion, therefore, impact plates 33 stay precisely where they should be. The gap sizes for C1 to C3 are thus properly maintained without requiring a conventional complex holding mechanism.

(3) Covering member 68 covers where nut member 66 and bolt member 67, constituting forward-backward component 65 are housed in casing 31, thereby preventing the screw portion from dust contamination during crushing or from water permeation during washing of casing 31. Forward-backward component 65 can thus function accurately for a long time.

(4) Particularly, because covering member 68 has a bellow-like flexible component 682, it can extend or contract covering member 68 to catch up with the forward-backward motion of bolt member 67 or push-up motion of the entire forward-backward component 65. Nut member 66 and bolt member 67 can thus be covered very well all the time, thereby ensuring accurate functioning of forward-backward component 65. Consequently, the durability of gap adjustment device 60 improves as well.

(5) Drive component 63 of gap adjustment device 60 is fixed onto movable casing 80. The reliability of drive component 63 thus becomes much better than the one fitted onto impact plates 33 which would be exposed to significant vibration.

(6) Impact plates 33 make circular motion around rotation shaft 38 wherein the direction of the circular motion slightly deviates from that of the linear motion of forward-backward component 65. As a result, when impact plates 33 move, forward-backward component 65 slants, generating an external force onto drive component via mesh component 661 of nut member 66, which usually buckles drive component 63.

Nonetheless, drive component 63 in this embodiment, is fixed onto movable casing 80 via rubber members 636 and 637. Therefore, even though forward-backward component 65 is slanted to some degree due to the shift toward the revolving direction that impact plates 33 make, rubber members 636 and 637 deform to absorb the external force generated due to the above slant. Buckling of drive component 63 is thus effectively prevented. Hence, the meshed state between drive component 63 and mesh component 661 is maintained very well and power is accurately transmitted from drive component 63 to nut member 66.

(7) Also because drive component 63 is provided outside movable casing 80, the mesh portion can be kept free of dust contamination and the like and maintenance service for drive component 63 can be easily provided while movable casing 80 is closed (in the operating position).

(8) Gaps between stroke plates 322 and impact plates 33 are automatically adjusted in such a way that the control means regulates hydraulic motor 64 based on a detected signal of the revolution amount transmitted by detection sensor 693. Therefore, the requirement for manual adjustment of the gaps C1 to C3 through visual monitoring of the gap size is eliminated, providing easy and precise adjustment of operation.

(9) When impact plates 33 are moved toward stroke plates 322 to bump into stroke plates 322 or rotor body 321, forward-backward component 65 is pushed up. The collision of impact plates 33 with rotor 32 is thus prevented, consequently preventing damages from such a collision.

(10) Even though impact plates 33 (particularly, first impact plate 331) does not contact the rotor 32 side and continues to move largely, regulation link 336 regulates such movement, thereby preventing bolt member 67 from extending more than necessary, thus preventing its fall from nut member 66.

(11) Operation component 662, which is used for manually rotating nut member 66 by inserting a tool, is provided on top of nut member 66. Therefore, when drive component 63 or the control means or the like does not operate for some reason, nut member 66 can be rotated by operation component 662 to manually adjust gaps C1 to C3.

It should be noted that the drive component 63 for the gap adjustment device 60 is provided outside casing 31 but it can be provided inside casing 31.

Moreover, in forward-backward component 65 of the above embodiment, nut member 66 is fitted to the side of movable casing 80 and bolt member 67 is fitted to the side of impact plates 33, however, these positions are interchangeable. In other words, one may arbitrarily fit nut member 66 to the impact plate 33 side while one may arbitrarily fit bolt member 67 to the side of movable casing 80.

Forward-backward component 65 of the above embodiment was of a screw type in which nut member 66 is screwed or meshed with bolt member 67. The gap adjustment device of the present invention is not limited to this embodiment.

For example, the casing-side member of the present invention may be constructed with a pinion gear, and impact plate side member may be constructed with a rack that meshes with the pinion gear.

Also, in the gear type utilizing a rack and a pinion, the rack side may have a circular shape along the locus of impact plates 33. In this way, even though impact plate 33 moves, the meshed position will not move, thereby simplifying the construction of the meshed portion.

Further, in stationary casing 70, such a circular rack may be fixed onto the inner surfaces of both side members 72 on the stationary casing side, while pinion gears are rotatably attached to each end in the horizontal direction on the impact plates 33 side. In this case, as the pinion gears rotate, the pinion gears roll on the rack, thereby moving impact plates 33.

The above-mentioned configuration can also move impact plates 33 without a spike and does not move impact plates 33 during crushing operations.

Gap adjustment device 60 is constructed with first gap adjustment device 61 and second gap adjustment device 62 to turn first and second arms 334 and 335 separately. However, where there is only one arm, there can be a single gap adjustment device 60; and when there are more than three arms, there can be more than three gap adjustment devices 60. Any number of gap adjustment devices 60 can be arbitrarily determined according to the number of arms.

What is claimed is:

1. A gap adjustment device (60) for an impact crusher (30) comprising:

a rotor (32) having a stroke plate (322);

impact plates (33) arranged with said stroke plates (322) having gaps (C1, C2, and C3) there between;

a casing (31) having a movable casing component (80) and a stationary component with said rotor (32) connected to the stationary component and said impact plates (33) fitted to said movable casing component (80);

a forward-backward component (65) supported by said movable casing component (80) with said forward-backward component (65) including a casing side member (66) and an impact plate side member (67) threadably fastened to said a casing side member (66); and a drive component (63) connected to said movable component (80) and being rotationally coupled to said forward-backward component (65) for rotating said casing side member (66) so as to permit said forward-backward component (65) to move in a push up direction in response to a substantial impact of said impact plate (33) with said stroke plate (322) or said rotor (32);

wherein said gaps (C1, C2, and C3) between said stroke plate (322) and impact plates (33) can be adjusted in accordance with the number of revolutions made by said casing side member (66).

2. A gap adjustment device (60) for an impact crusher (30) as set forth in claim 1 characterized by said impact plate side member (67) and casing side member (66) being meshed together and covered by a covering member (68) having a flexible component (682); wherein both ends of said covering member (68) in an extension/contraction direction are fitted to the impact plate side member (67) and the casing side member (66).

3. A gap adjustment device (60) for an impact crusher (30) as set forth in claim 2 characterized by said drive component (63) being configured so that it can rotate said casing side member (66), the drive component (63) being fitted to said casing (31) via flexible members (636 and 637).

4. A gap adjustment device (60) for an impact crusher (30) as set forth in claim 2 characterized by said casing side member (66) being configured so that it can be rotated by said drive component (63) or can be rotated by an operation component (662) that can be manually operated with a tool.

5. A gap adjustment device (60) for an impact crusher (30) as set forth in claim 1 characterized by said drive component (63) being configured so that it can rotate said casing side member (66), the drive component (63) being fitted to said casing (31) via flexible members (636 and 637).

6. A gap adjustment device (60) for an impact crusher (30) as set forth in claim 5 characterized by said casing side member (66) being configured so that it can be rotated by said drive component (63) or can be rotated by an operation component (662) that can be manually operated with a tool.

7. A gap adjustment device (60) for an impact crusher (30) as set forth in claim 1 characterized by said casing side member (66) being configured so that it can be rotated by said drive component (63) or can be rotated by an operation component (662) that can be manually operated with a tool.

8. A gap adjustment device (60) for an impact crusher (30) as set forth in claim 1 characterized in that said gap adjustment device (60) further comprises: a push-up detection sensor (694) for detecting push-up movement of said forward-backward component (65).

* * * * *